US005867851A

United States Patent [19]

Mariol et al.

[11] Patent Number: 5,867,851

[45] Date of Patent: Feb. 9, 1999

[54] PLAY YARD

[75] Inventors: John V. Mariol, Cincinnati, Ohio; Thomas J. Welsh, Jr., Naperville, Ill.

[73] Assignee: Kolcraft Enterprises, Inc., Chicago, Ill.

[21] Appl. No.: 872,225

[22] Filed: Jun. 10, 1997

Related U.S. Application Data

[63] Continuation-in-part of Ser. No. 711,541, Sep. 10, 1996.

[51] Int. Cl.[6] ..... A47D 7/00; A47D 13/06

[52] U.S. Cl. ..... 5/99.1; 5/93.1; 5/93.2

[58] Field of Search ..... 5/93.1, 93.2, 99.1

[56] References Cited

U.S. PATENT DOCUMENTS

| | | | |
|---|---|---|---|
| Re. 25,195 | 7/1962 | Hamilton | 5/98 |
| D. 145,052 | 6/1946 | Boisselier | D34/5 |
| D. 158,030 | 4/1950 | Wagner | D5/5 |
| D. 186,358 | 10/1959 | Fulton | D5/5 |
| D. 192,072 | 1/1962 | Hamilton | D5/5 |
| D. 193,326 | 8/1962 | Hamilton | D5/5 |
| D. 197,551 | 2/1964 | Choy et al. | D5/5 |
| D. 244,890 | 7/1977 | Adams | D6/13 |
| D. 257,299 | 10/1980 | Cone | D6/13 |
| D. 281,745 | 12/1985 | Pandorf et al. | D6/390 |
| D. 304,523 | 11/1989 | Dillner et al. | D6/391 |
| D. 316,339 | 4/1991 | Taylor | D6/391 |
| D. 323,589 | 2/1992 | Mariol | D6/331 |
| D. 339,922 | 10/1993 | Williams | D6/331 |
| D. 366,978 | 2/1996 | Mariol | D6/491 |
| 540,863 | 6/1895 | Lawson . | |
| 1,211,730 | 1/1917 | Lucas . | |
| 1,374,333 | 4/1921 | Stotler et al. . | |
| 1,413,068 | 4/1922 | Stotler et al. . | |
| 1,630,941 | 5/1927 | Hood . | |
| 1,779,060 | 10/1930 | Choate . | |
| 1,782,217 | 11/1930 | Stoddard . | |
| 1,975,332 | 10/1934 | Rehkopf | 5/98 |
| 2,287,907 | 6/1942 | Schettler, Jr. | 5/98 |
| 2,308,608 | 1/1943 | Kennedy | 5/99 |
| 2,464,866 | 3/1949 | Holtz | 5/98 |
| 2,486,054 | 10/1949 | Morse | 5/99 |
| 2,486,067 | 10/1949 | Schroeder | 5/99 |
| 2,490,296 | 12/1949 | Fournier | 5/99 |
| 2,491,036 | 12/1949 | Dodge | 5/99 |
| 2,498,203 | 2/1950 | Fischer | 5/98 |
| 2,523,422 | 9/1950 | Dunn | 5/99 |
| 2,561,637 | 7/1951 | Rex | 5/99 |
| 2,563,446 | 8/1951 | Abel | 5/99 |
| 2,569,937 | 10/1951 | Lindgren | 5/99 |
| 2,574,079 | 11/1951 | White | 5/99 |
| 2,590,315 | 3/1952 | Hawley, Jr. | 5/98 |
| 2,607,052 | 8/1952 | Le Roy | 5/317 |
| 2,617,999 | 11/1952 | Mitchell | 5/99 |
| 2,624,054 | 1/1953 | Plant | 5/99 |
| 2,629,110 | 2/1953 | Fournier | 5/99 |
| 2,650,375 | 9/1953 | Serrell | 5/99 |
| 2,659,903 | 11/1953 | Hagelfeldt | 5/99 |
| 2,697,843 | 12/1954 | Skrmetti | 5/99 |
| 2,698,443 | 1/1955 | Ralick | 5/99 |
| 2,710,976 | 6/1955 | Martensen | 5/98 |
| 2,784,420 | 3/1957 | Moltane | 5/98 |
| 2,790,978 | 5/1957 | Tigrett | 5/98 |
| 2,809,382 | 10/1957 | Jackson | 5/99 |
| 2,837,752 | 6/1958 | Wilkerson | 5/99 |
| 2,873,458 | 2/1959 | Adamson | 5/98 |
| 2,901,755 | 9/1959 | Wood, Jr. | 5/99 |
| 2,908,021 | 10/1959 | Fulton | 5/99 |
| 2,913,739 | 11/1959 | White | 5/99 |
| 2,922,169 | 1/1960 | Werner | 5/98 |
| 2,942,750 | 6/1960 | Neely | 220/6 |
| 2,958,084 | 11/1960 | Kenney | 5/99 |
| 2,992,441 | 7/1961 | Landry | 5/99 |
| 3,018,493 | 1/1962 | Wittbrodt | 5/99 |
| 3,063,065 | 11/1962 | Shaw | 5/99 |
| 3,064,277 | 11/1962 | Gill | 5/98 |
| 3,091,249 | 5/1963 | O'Neil | 135/16 |
| 3,092,847 | 6/1963 | DePuy | 5/99 |
| 3,095,583 | 7/1963 | Golub et al. | 5/99 |
| 3,103,670 | 9/1963 | Landry | 5/99 |
| 3,127,620 | 4/1964 | Peterson | 5/99 |
| 3,158,876 | 12/1964 | Gottlieb | 5/99 |
| 3,165,760 | 1/1965 | Abajian | 5/97 |
| 3,173,155 | 3/1965 | Schweikert | 5/98 |
| 3,183,527 | 5/1965 | Turner | 5/98 |
| 3,183,528 | 5/1965 | Jacobs et al. | 5/99 |
| 3,206,772 | 9/1965 | Sarasin | 5/99 |
| 3,233,254 | 2/1966 | Golub et al. | 5/99 |
| 3,296,633 | 1/1967 | Rieger | 5/99 |
| 3,309,718 | 3/1967 | Sarasin | 5/98 |
| 3,430,273 | 3/1969 | Stillwaugh | 5/98 |

| | | | |
|---|---|---|---|
| 3,474,472 | 10/1969 | Hamilton, II | 5/98 |
| 3,605,139 | 9/1971 | Lorentz, Jr. | 5/99 R |
| 3,777,321 | 12/1973 | Hargett | 5/99 C |
| 3,789,439 | 2/1974 | Berg et al. | 5/99 C |
| 3,800,341 | 4/1974 | Davanzo | 5/99 R |
| 3,924,280 | 12/1975 | Vaiano | 5/98 R |
| 4,008,497 | 2/1977 | Badon | 4/171 |
| 4,008,499 | 2/1977 | Wren, Jr. et al. | 5/99 C |
| 4,044,411 | 8/1977 | Peterson | 5/99 X |
| 4,069,524 | 1/1978 | Carlo | 5/99 B |
| 4,070,716 | 1/1978 | Satt et al. | 5/99 C |
| 4,073,017 | 2/1978 | Stevens | 5/97 |
| 4,186,454 | 2/1980 | Cone | 5/99 R |
| 4,202,065 | 5/1980 | Sullivan | 5/99 A |
| 4,357,735 | 11/1982 | Saint et al. | 16/224 |
| 4,376,318 | 3/1983 | Cirillo | 5/99 C |
| 4,433,447 | 2/1984 | Mathou | 5/93 R |
| 4,455,697 | 6/1984 | Rovida | 5/99 C |
| 4,483,026 | 11/1984 | Kassai | 5/99 R |
| 4,493,120 | 1/1985 | Watts | 5/99 B |
| 4,499,619 | 2/1985 | Kassai | 5/99 A |
| 4,538,309 | 9/1985 | Gunter | 5/99 B |
| 4,561,138 | 12/1985 | Hwang | 5/102 |
| 4,573,224 | 3/1986 | Saint | 5/99 C |
| 4,599,832 | 7/1986 | Benton et al. | 52/118 |
| 4,635,305 | 1/1987 | Wyss | 5/99 R |
| 4,651,367 | 3/1987 | Osher et al. | 5/99 R |
| 4,669,138 | 6/1987 | Kassai | 5/99 C |
| 4,683,600 | 8/1987 | Beger | 5/99 C |
| 4,688,280 | 8/1987 | Kohus et al. | 5/99 R |
| 4,692,953 | 9/1987 | Fetters | 5/99 R |
| 4,703,525 | 11/1987 | Shamie | 5/99 R |
| 4,710,049 | 12/1987 | Chang | 403/23 |
| 4,739,527 | 4/1988 | Kohus et al. | 5/99 R |
| 4,750,223 | 6/1988 | D'Arcy et al. | 5/99 B |
| 4,811,437 | 3/1989 | Dillner et al. | 5/99 B |
| 4,815,153 | 3/1989 | Bleser et al. | 5/98 R |
| 4,819,285 | 4/1989 | Fetters | 5/99 R |
| 4,837,875 | 6/1989 | Shamie et al. | 5/99 C |
| 4,899,496 | 2/1990 | Chew, II | 5/98 R |
| 4,900,011 | 2/1990 | Nolet | 272/65 |
| 4,921,369 | 5/1990 | Chew, II et al. | 403/171 |
| 4,934,025 | 6/1990 | Mariol | 16/347 |
| 4,967,432 | 11/1990 | Kujawski et al. | 5/98 |
| 4,985,948 | 1/1991 | Mariol | 5/99.1 |
| 5,025,517 | 6/1991 | Johnson | 5/99.1 |
| 5,172,435 | 12/1992 | Griffin et al. | 5/95 |
| 5,193,234 | 3/1993 | Joaquin | 5/99.1 |
| 5,197,154 | 3/1993 | Shamie | 5/99.1 |
| 5,211,498 | 5/1993 | Huang | 403/102 |
| 5,212,841 | 5/1993 | Binnersley | 5/99.1 |
| 5,228,154 | 7/1993 | Brevi et al. | 5/99.1 |
| 5,239,714 | 8/1993 | Huang | 5/99.1 |
| 5,241,716 | 9/1993 | Kohus | 5/99.1 |
| 5,243,718 | 9/1993 | Shamie | 5/99.1 |
| 5,279,006 | 1/1994 | Teng | 5/99.1 |
| 5,293,656 | 3/1994 | Chan | 5/99.1 |
| 5,339,470 | 8/1994 | Shamie | 5/98.1 |
| 5,353,451 | 10/1994 | Hsiung | 5/99.1 |
| 5,358,220 | 10/1994 | Yu-Kuang | 256/25 |
| 5,363,521 | 11/1994 | Garland et al. | 5/99.1 |
| 5,367,725 | 11/1994 | Tsai | 5/99.1 |
| 5,377,368 | 1/1995 | Cheng | 5/991 |
| 5,381,570 | 1/1995 | Cheng | 5/99.1 |
| 5,542,134 | 8/1996 | Wang | 5/99.1 |
| 5,553,336 | 9/1996 | Mariol | 5/93.1 |
| 5,664,267 | 9/1997 | Cheng | 5/99.1 |
| 5,706,533 | 1/1998 | Opheim et al. | 5/93.1 X |

FOREIGN PATENT DOCUMENTS

| | | |
|---|---|---|
| 0952496 | 8/1974 | Canada . |
| 1557841 | 7/1969 | France . |
| 2361846 | 3/1978 | France . |
| 043051 | 8/1887 | Germany . |
| 0481037 | 7/1929 | Germany . |

*Primary Examiner*—Brian K. Green
*Assistant Examiner*—Robert G. Santos
*Attorney, Agent, or Firm*—Marshall, O'Toole, Gerstein, Murray & Borun

[57] ABSTRACT

A multi-sided play yard having a collapsible top assembly and a collapsible bottom assembly, each assembly connected to at least three spaced vertical posts. The bottom assembly includes a collapsible assembly with collapsible legs. The collapsible legs each include leg portions pivotally connected to a respective vertical post and to a multiple pivot joint member. Stabilizer feet are pivotally connected to each collapsible leg by a multiple pivot joint member. The vertical posts, leg members, and stabilizer feet serve to support and stabilize the play yard when it is in an erected position.

25 Claims, 31 Drawing Sheets

PLAY YARD

This application is a continuation-in-part of application Ser. No. 08/711,541, filed Sep. 10, 1996.

FIELD OF INVENTION

The invention disclosed herein relates generally to a play yard for infants and children and, more particularly, to an improved three-sided, preferably triangular-shaped, play yard having a collapsible top and bottom assembly.

BACKGROUND OF THE INVENTION

Play yards are well known. Generally, they include a rectangular shape comprising four corner legs with structure for collapsing the top and bottom assemblies whereby the play yard can be folded in a compact position for storage and portability. While such play yards are satisfactory, it is desired to have a portable, collapsible play yard which is somewhat less cumbersome to collapse by reason of reducing the number of play yard sides. It is further desired to eliminate a play yard side and associated corner leg structure to reduce costs but at the same time the play yard must be relatively easy to erect, and, when erected to a use position, the play yard must be stable and support loads normally attendant with such devices. It is still further desired to provide such a play yard with a minimum of components and with a significantly simplified frame assembly which can be more readily collapsed and erected.

SUMMARY OF THE INVENTION

Briefly, applicants' invention, as disclosed and claimed herein, is directed to obviating the above-described problems and achieving the desires for a play yard. The play yard of the present invention is relatively readily erected and collapsed while being easily portable. Additionally, the play yard employs a bottom assembly which includes a plurality of leg members each member having leg portions which are positioned to assist in providing the requisite lateral stability.

The play yard preferably employs three spaced vertical posts and collapsible top and bottom assemblies forming a three-sided top assembly. The top assembly includes three rail assemblies. Each rail assembly includes a pair of rail members connected to a locking rail joint. Each rail member also is pivotally connected to a vertical post. The top assembly is adapted to collapse downwardly at the location of the locking rail joints.

The bottom assembly includes a collapsible three-sided base assembly, preferably triangular in shape. The three legs of the three-sided assembly each include a first leg portion and a second leg portion. One end of each leg portion is joined to a vertical post located at each of the apices of the three-sided assembly while the remaining ends of the leg portions are pivotally connected to a leg pivot joint of a multiple pivot joint member, with the leg pivot joint designed to pivot a predetermined amount.

A load bearing stabilizer foot is pivotally connected to a stabilizer foot pivot joint of each multiple pivot joint member. Preferably, each stabilizer foot is spaced equidistant from adjacent vertical posts with a stabilizer foot being positioned away from the vertical central axis of the device and outside a plane which intersects the vertical axes of a pair of vertical posts adjacent the stabilizer foot. Each stabilizer foot has a lock which prevents inadvertent pivoting of the leg portions when the play yard is in an assembled position.

In the event the perimeters of the top and bottom assemblies vary, the stabilizer feet are located away from the vertical center axis of the play yard at a location which is at least on the edge of the maximum perimeter of the assemblies, but more preferably, outside the maximum perimeter in order to assist the play yard from tipping.

A pedestal is mounted to each vertical post to pivotally connect the vertical posts to the divergent legs of the collapsible three-sided assembly. The vertical posts and stabilizer feet in addition to a pylon disposed centrally on said bottom panel support the play yard when it is in an erected position.

A plastic or cloth fabric panel assembly encloses the play yard. It includes three side panels which drape and depend from the top rail members. If desired, the side panels can be or include a mesh material. The side panels are joined along their respective bottom edges to a bottom fabric panel, the latter being adapted to seat on the bottom support assembly including the stabilizer feet pedestals. A removable, flexible base insert is adapted to be inserted in the play yard to create a floor when the play yard is in an erected, use position. The insert is maintained in position by the geometrical configuration of the vertical posts and stabilizer foot pedestals which serve to preclude the base insert from shifting from its normal inserted position.

When assembled in an open, in-use position, the leg portions of the lower support assembly extend downwardly over center at an angle $\beta$ of approximately between 2°–8° and preferably 4°–6° to assist in providing the desired lateral tension to the entire frame. The erected frame alone provides substantial desired rigidity.

The stabilizer feet are configured to be an integral part of the lower assembly and serve to support vertical and horizontal loading and positioning of the base insert while precluding the play yard from tipping over. The pivotal connection of the stabilizer feet enables their pivotal movement from a transverse position when the play yard is in an open erect position to a position in which they are substantially aligned with the connecting base assembly leg portions during collapsing of the play yard.

Two straps or connectors each have one end which attaches to each stabilizer foot. The remaining end of one strap connects to the bottom surface of the bottom panel to assist in positioning a stabilizer foot in the appropriate position upon assembly or opening of the play yard. The remaining end of the second strap also connects to the bottom surface of the bottom panel to assist in positioning the stabilizer foot in the appropriate position upon collapse or closing of the play yard.

The divergent positioning of the legs of the base or bottom assembly, which, in an erected position, preferably angle outwardly approximately sixty degrees (60°) from each other, also provide structural support for a flexible, semi-rigid base insert with the base assembly being, in part, located contiguous to the perimeter of the base insert.

Additionally, it preferably is desired to utilize flexible cross straps to support the vertical loads acting on the play yard. Each strap is connected to a pair of adjacent legs of the bottom assembly to provide vertical load floor support.

The present invention provides a three-sided play yard, preferably triangular-shaped, which provides the desired rigidity when erected to an in-use position while eliminating a side and corner structure from a conventional four-sided play yard. Moreover, the play yard of the present invention assures that the vertical loads to be carried and supported by the play yard will be supported by the stabilizer feet, vertical posts, and pylon while lateral stability and loading is accommodated by the positioning and arrangement of the leg portions below a normal center position. The play yard of the present invention can be readily erected to a use position or collapsed to a folded position.

Other advantages will become apparent from a description of the drawings and detailed description.

DETAILED DESCRIPTION

Figure 1:
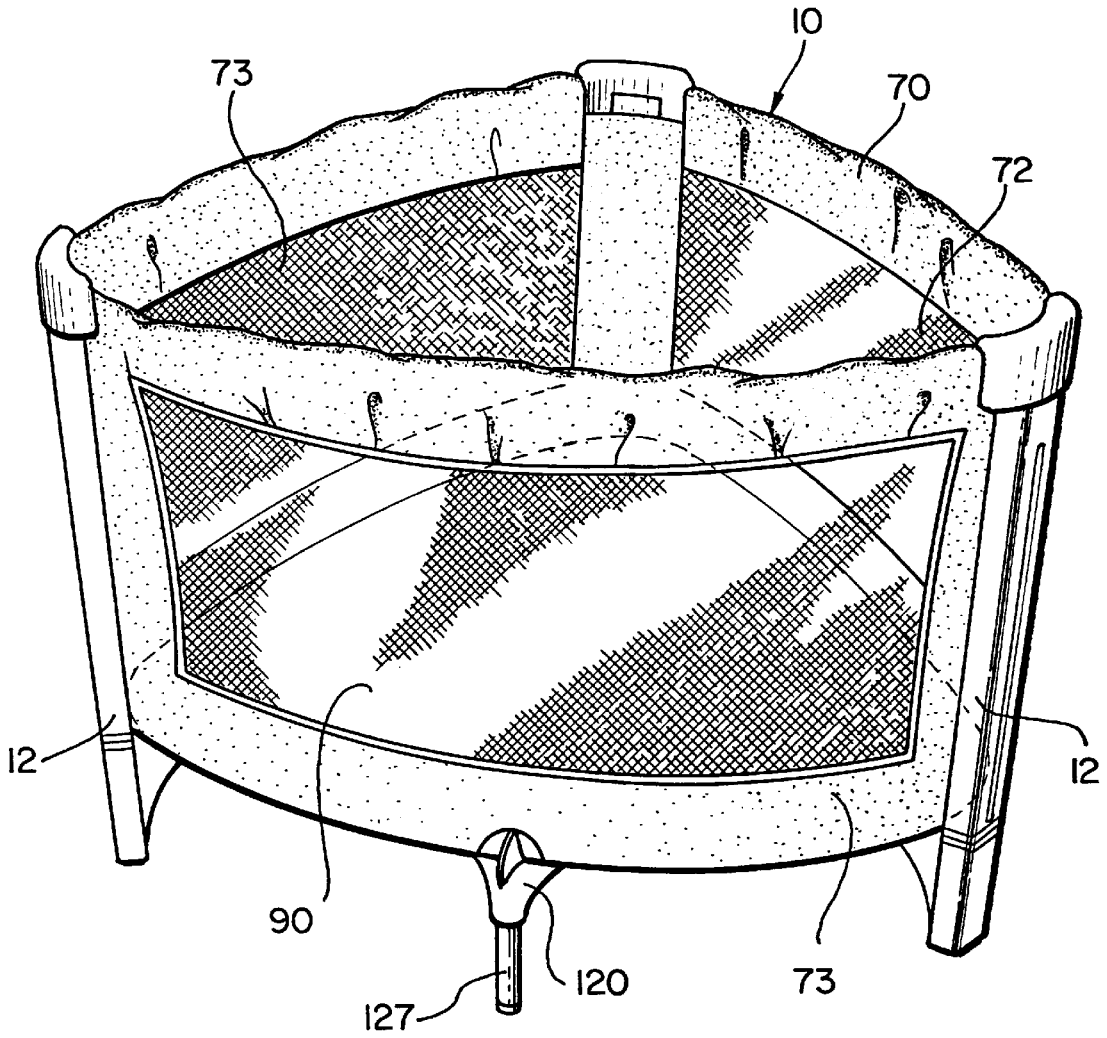
FIG. 1 shows a perspective view of a triangular-shaped play yard of the present invention with the play yard in an erected use position.
Figure 4:
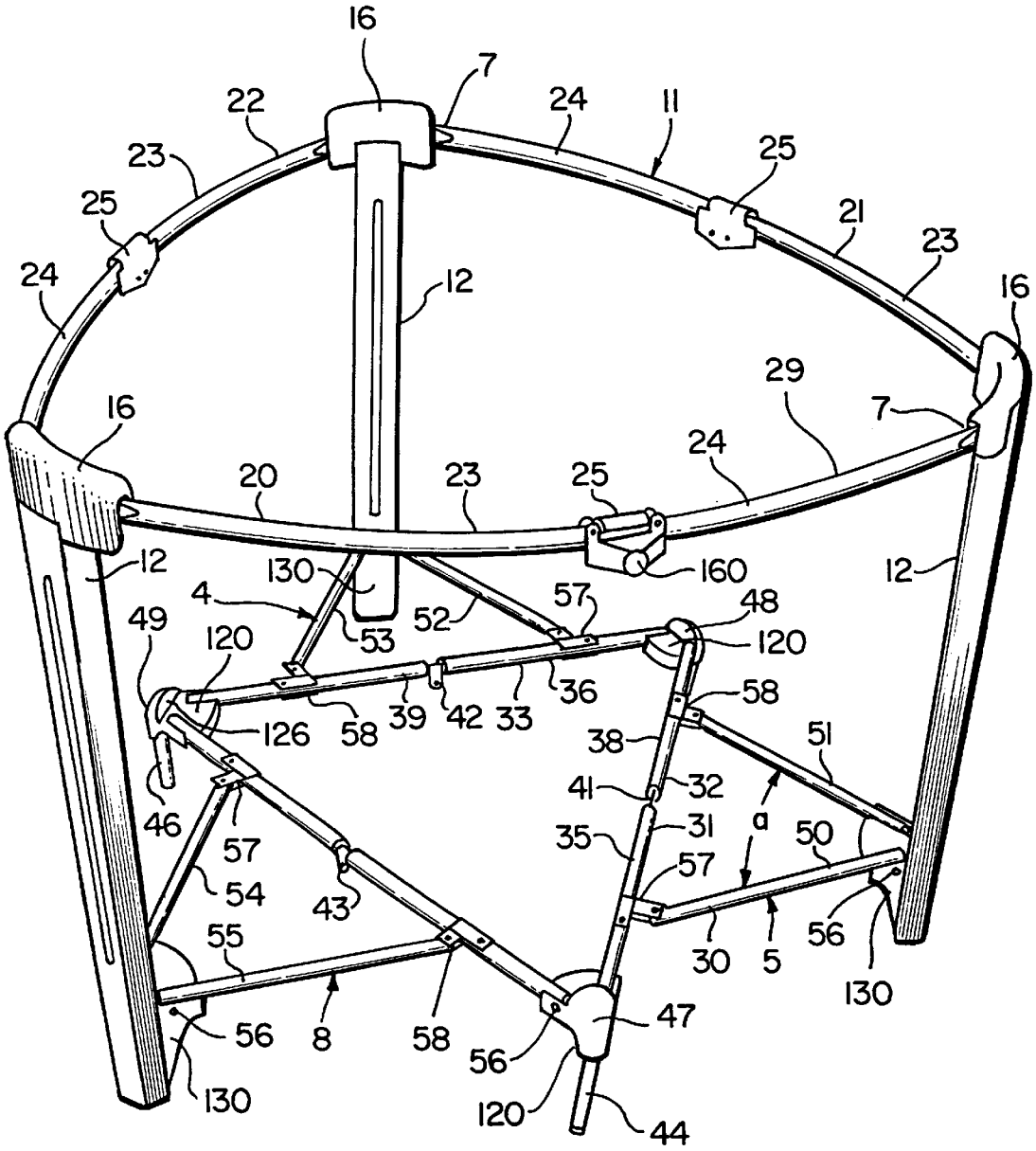
FIG. 4 shows a perspective view of the frame of the play yard of the present invention in the erected position.
Figure 5:
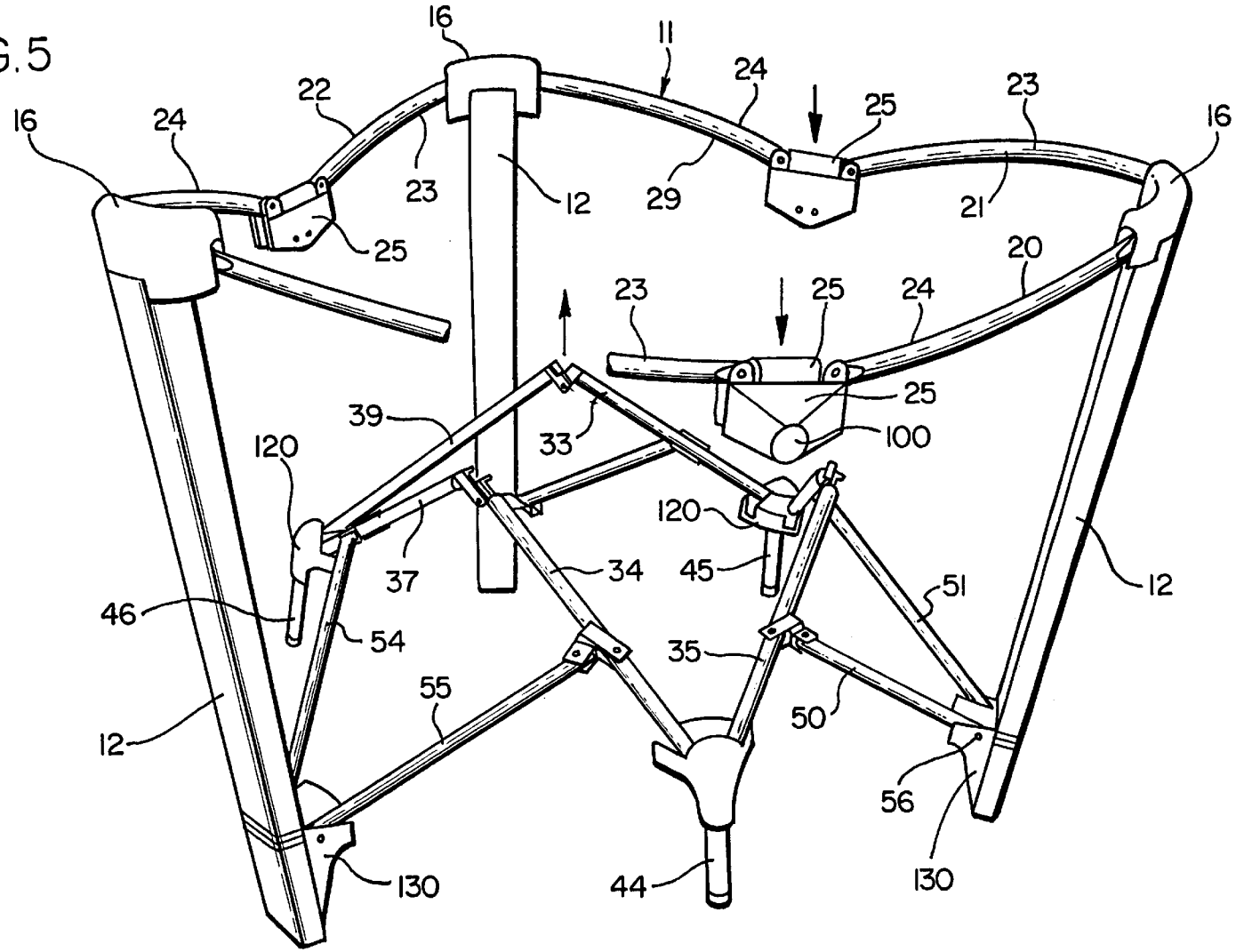
FIG. 5 shows a fragmentary, perspective view of the figure of FIG. 4 with the top assembly and bottom assembly partially collapsed.

Referring to the drawings and particularly FIGS. 4 and 5, one embodiment of play yard 10 comprises frame 11. Frame 11 includes three vertical posts 12, each post having an upper and lower end. A collapsible top assembly 29 includes top rail assemblies 20, 21, 22 each comprising first and second rail members 23, 24. The rail members preferably are slightly bowed to provide a curved configuration such as shown in FIG. 1. Each rail member has one end pivotally connected to a vertical post 12 and a second end pivotally fastened to locking rail joint 25. Cap assembly 16 is disposed over the top end of post 12 and encloses the pivotal connection between a post and corresponding rail members in a manner further described hereafter.

The bottom assembly 30 of play yard 10 includes a collapsible triangular-shaped subassembly 31 which preferably is in the form of an equilateral triangle. The triangle legs 32, 33, 34, respectively, include first leg portions 35, 36, and 37 and second leg portions 38, 39, and 40. One end of each leg portion, e.g., 35, 38 of leg 31, is connected to a pivot joint 41, 42, or 43.

Pedestal 120 is located at each of the three apices 47, 48, 49 of triangular-shaped subassembly 31. Stabilizer feet 44, 45, 46 depend from pedestals 120. Each stabilizer foot is located away from the vertical center axis of the play yard and preferably is located at a point which is beyond a vertical plane which intersects the vertical axes of the vertical posts 12 which are adjacent a stabilizer foot. A stabilizer foot preferably is equally spaced from adjacent vertical posts 12 such that three stabilizer feet and three vertical posts shown in FIG. 4 effectively stabilize the play yard when it is in an erected position.

The stabilizer feet also can be located at the edge of, or more preferably, beyond the maximum outer periphery of the top assembly, bottom assembly or base insert whichever outer perimeter is the largest.

Three pairs of first and second post connecting members (50, 51), (52, 53), and (54, 55) connect vertical posts 12 to triangular-shaped subassembly 31. Specifically, first post connecting members 50, 52, and 54 each have one end pivotally fastened to pedestal 130 at 56, the pedestal being located contiguous to the lower end of vertical posts 12. The remaining ends of the first post connecting members are connected by swivel joint 57 to the respective first leg portions 35, 36, 37 of triangular-shaped subassembly 31. Similarly, second post connecting members 51, 53, and 55, which are positioned at an angle "a" of approximately 600 to the first connecting post members in the erected position, are pivotally connected at 56 to one end to pedestal 130 while the remaining ends are connected by swivel joint 58 to the respective second leg portions 38, 39, 40. It will be noted, for example, viewing FIG. 4, that post connecting members 53 and 54 are in interrupted axial alignment with one another. Similarly, post connecting members 51, 52 and 50, 55 also are in interrupted axial alignment when the play yard is in an erected position. This alignment is preferred inasmuch as the post connecting members serve to support a base insert.

As seen, for example, in FIG. 4, the post connecting member and leg portions of triangular subassembly 31 form three truss segments 3, 4, 5. The truss segments in conjunction with the subassembly 31 form a truss 8. Truss 8 in conjunction with the vertical posts 12 and stabilizer feet serve to provide a play yard which, when erected, is relatively substantially rigid and stable.

Figure 10:
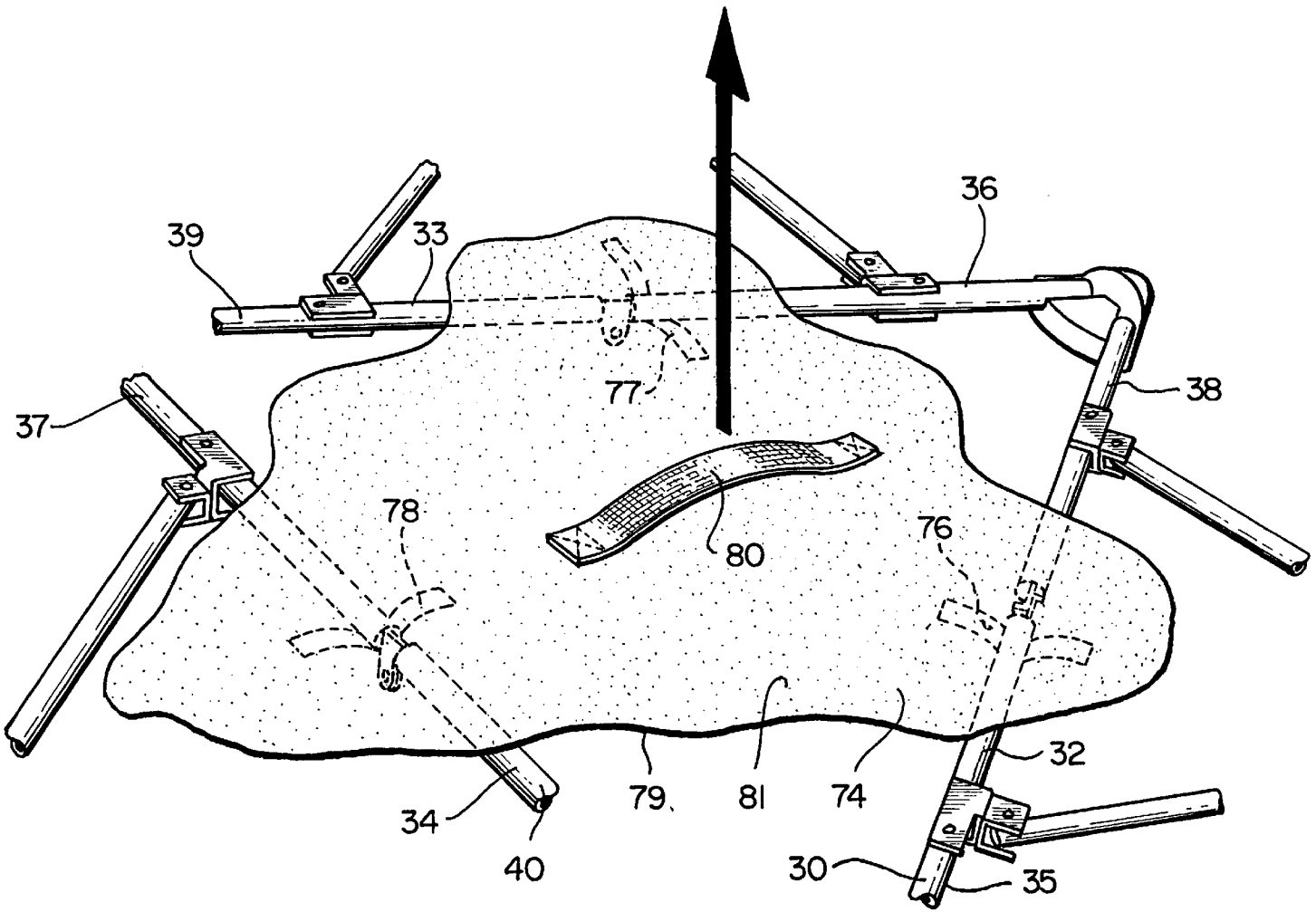
FIG. 10 shows a fragmentary, perspective view of the fabric base panel having a handgrip on its upper surface and attached at its lower surface to the legs of the triangular-shaped subassembly.

Referring to FIG. 1, a panel assembly 70, which is made of a conventional cloth, plastic fabric or other suitable fabric material, is disposed on frame 11. Assembly 70 includes three side panels 71, 72, 73 and bottom panel 74. The top of each side panel member is disposed over a respective rail member 23, 24 and rail joint 25, and stitched or formed to form a sleeve which encloses the rail members and rail joint. The side panels, which also can be a mesh material, if desired, drape downwardly. Bottom panel 74 is stitched or otherwise attached to the bottom edge of the three side panels and is positioned, when the play yard is in an erected position, to normally seat on top of bottom assembly 30. See FIG. 10. Plastic or cloth straps 76, 77, 78 are suitably fastened, by stitching or releasable snaps, to the lower surface 79 of bottom panel 74 and engage at least one of the leg portions 35–40 of triangular subassembly 31. Pull strap 80 is stitched to the upper surface 81 of bottom panel 74. Preferably, the straps 76–78 engage the bottom assembly 30 at the location of pivot joints 41, 42, 43. If desired, the joint engaging straps can be sewn together at one location on the bottom surface of the bottom panel.

Figure 2:
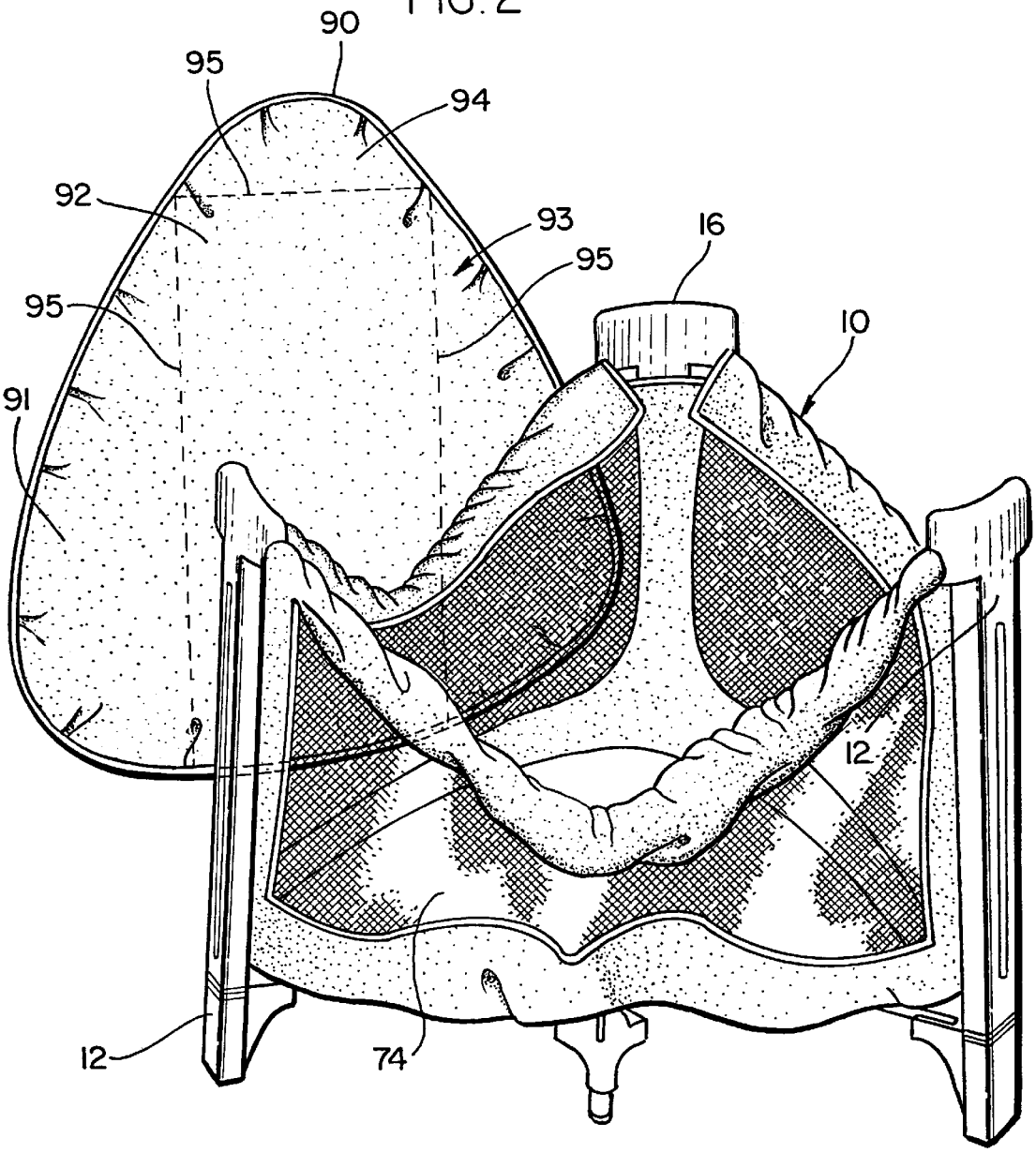
FIG. 2 shows a perspective view of the play yard of FIG. 1 with the base insert removed and the top assembly in a partially collapsed position.

Base insert 90, FIG. 2, is adapted to be inserted within the play yard when it is in an erected position and serves as the play yard floor. Preferably, insert 90 comprises a flexible foam or fabric pad over which is stretched or mounted a conventional plastic or cloth fabric material. The insert is formed into four discrete sections 91, 92, 93, 94, the insert sections being foldable relative to one another at the location of fold lines 95. When play yard 10 is in an erected, in use position, as shown in FIG. 1, insert 90 seats on top of bottom panel 74 and truss 8 and is configured to contact the lower inside surfaces of side panels 71, 72, 73. Insert 90 while being flexible, also is of sufficient rigidity such that when it is inserted in play yard 10, it assists in maintaining the side panels in a relatively taut condition, while providing a relatively soft floor surface for an infant or child disposed within the play yard. After the play yard is placed in a collapsed position of FIG. 3, insert 90 can be utilized as a wrap for enclosing play yard 10.

Figure 7:
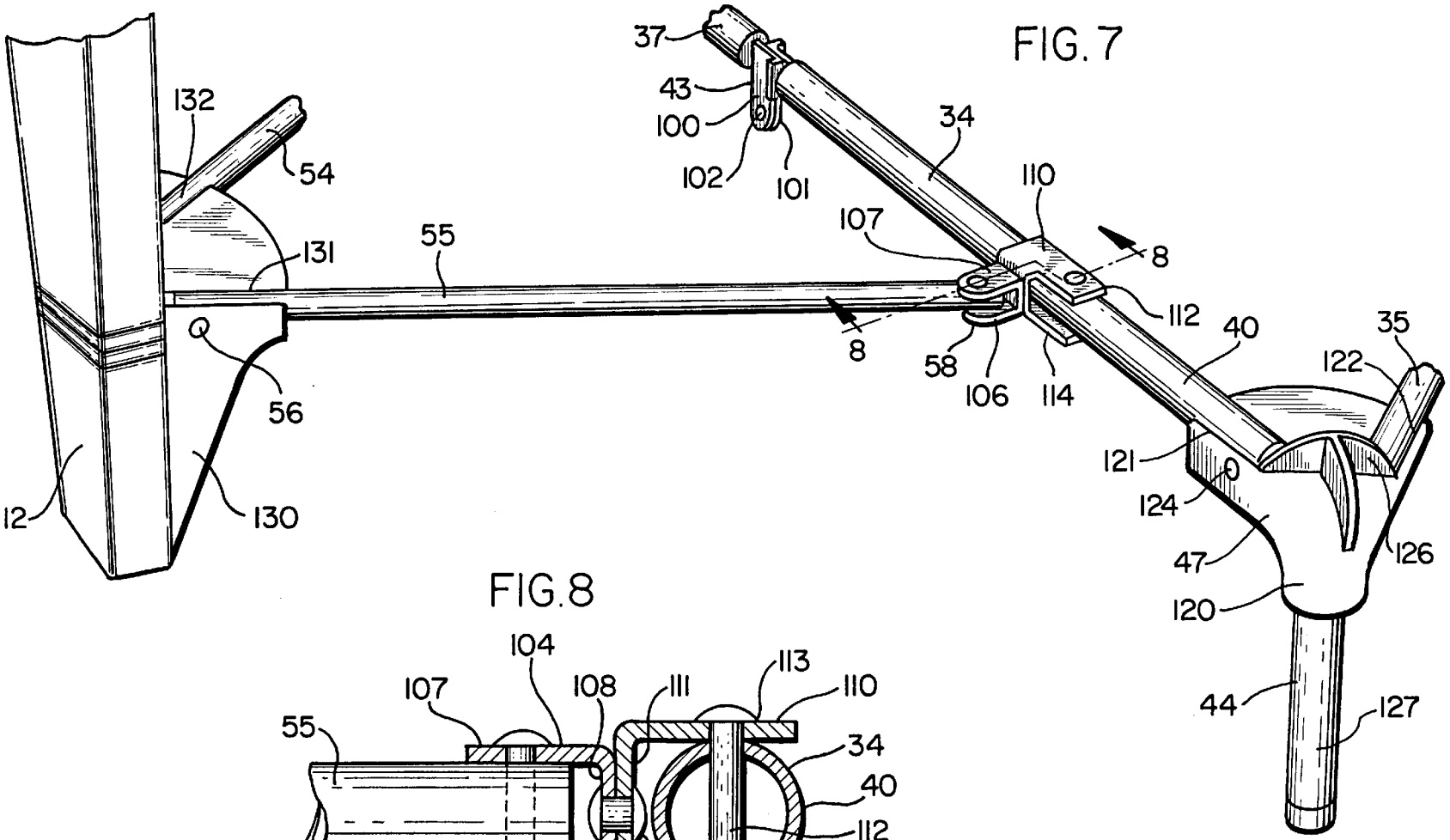
FIG. 7 shows a fragmentary, perspective view of the lower end of a vertical post having a pair of post connecting rod members pivotally connected to the vertical post and swivelly connected to a leg portion of a triangular-shaped subassembly, the play yard being in an erected position.
Figure 8:
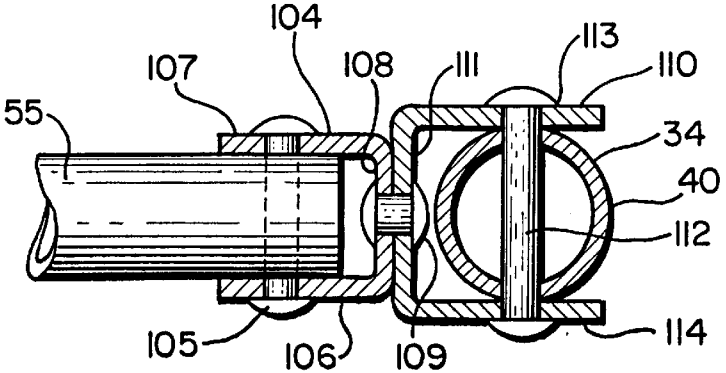
FIG. 8 shows a section view of a swivel joint taken along lines 8—8 in FIG. 7.
Figure 9:
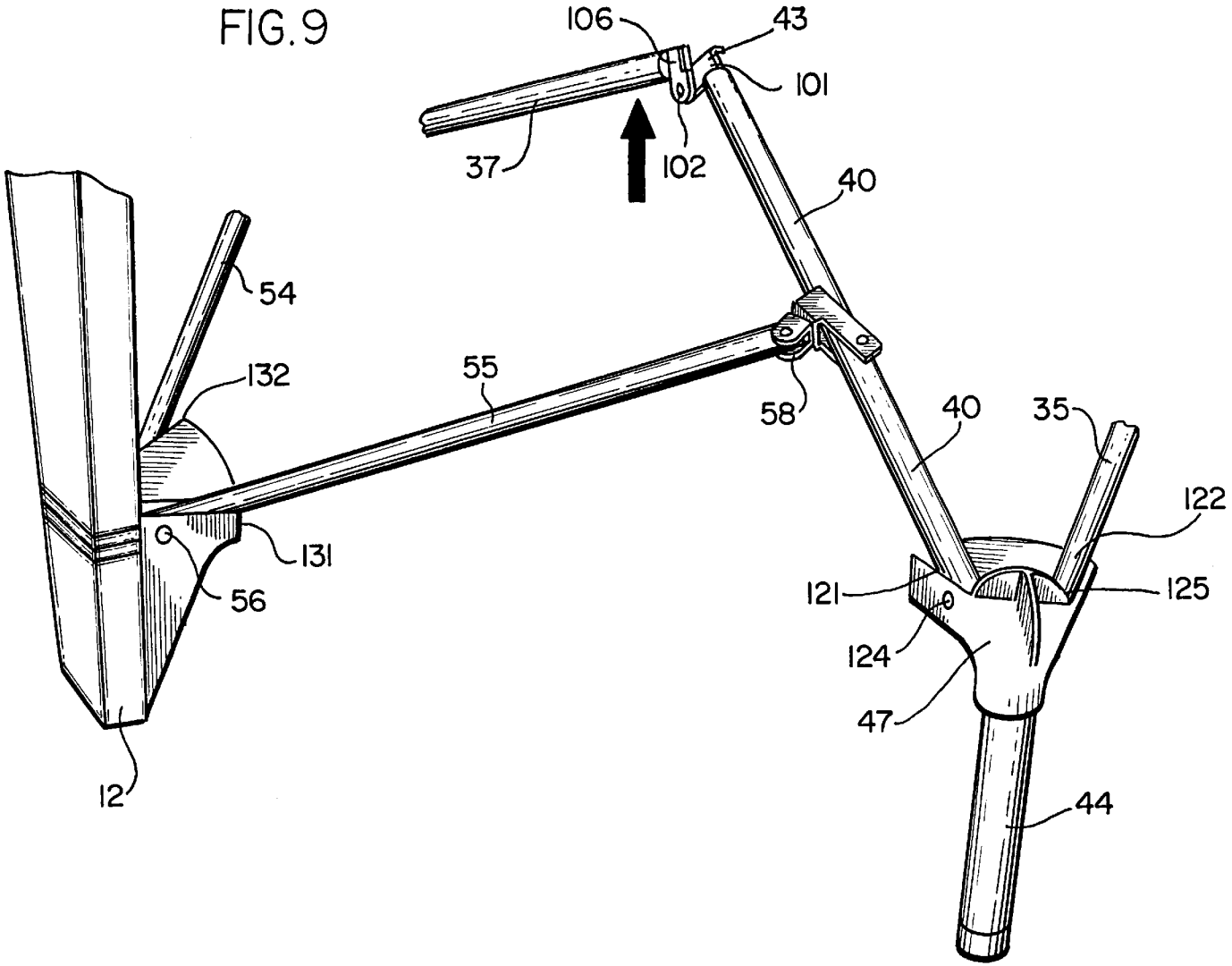
FIG. 9 shows the post connecting member of FIG. 7 in the course of collapse of the play yard.

Referring to FIGS. 7–9, pivot joint 43 includes a first bracket 100 fixed to an end of first leg portion 37, while a second bracket 101 is fixed to an end of second leg portion 40. Brackets 100, 101 are riveted or otherwise fastened together to allow the brackets to pivot relative to each other a predetermined amount at the location of the rivet or connector 102 which joins the two brackets as illustrated in FIGS. 7 and 9. The first and second leg portions are adapted to pivot downwardly when subassembly 31 is pulled upwardly in the direction of the arrow shown in FIG. 9; however, as seen in FIG. 7, the leg portions will remain substantially axially aligned with one another when in the erected position. Thus, the leg portions are permitted to pivot relative to one another a predetermined limited amount. Pivot joints 41 and 42 comprise the same structure utilized for pivot joint 43.

Swivel joint 58, utilized for example, with second leg portion 40 and post connecting member 55 includes a first U-shaped bracket 104 having bracket walls 106, 107. See FIG. 8. The second end of post connecting member 55 is riveted or otherwise fastened at 105 to the bracket walls so that post connecting member 55 pivots about bracket 104. Bracket base 108 is riveted at 109 to bracket base 111 of a second U-shaped bracket 110 whereby brackets 104 and 110 are adapted to rotate relative to one another at the location of rivet 109. Rivet 112 extends through second bracket walls 113, 114 and leg portion 40 whereby leg portion 40 pivots about second bracket 110. Swivel joints 57 utilize the same structure as described for swivel joint 58.

Pedestal 120 is located at each of the apices 47, 48, 49 of triangular-shaped subassembly 31, see FIGS. 7 and 9. Each pedestal includes slotted openings 121, 122 adapted to receive leg portions of triangular subassembly 31. The leg portions, e.g., 35, 40 are pivotally connected by a rivet or other suitable fastener to pedestal 120 at 124. Base insert stop 126 is disposed on the top of and integral with pedestal 120. The stops 126 are adapted to seat against base insert 90 so that, in conjunction with vertical posts 12, the movement of base insert 90 can be restricted when the insert is disposed in an erected play yard whereby the base insert cannot be substantially rotated out of its normal position. Stabilizer foot 127 is integrally fixed to pedestal 120. The pedestal and foot structures for apices 48 and 49 are the same as described for the pedestal located at apex 47.

Referring again to FIGS. 7 and 9, pedestal 130 is fixedly fastened to post 12 contiguous to the lower end thereof.

Pedestal 130 includes slotted openings 131, 132 for receipt of post connecting members 54, 55, the connecting members being pivotally connected by rivet or other suitable fastening means to pedestal 130 at the location of pivot 56, only one of which is shown in FIGS. 7 and 9. Similar pedestals 130 are fixed to the remaining vertical posts 12 for receipt of pivotal post connecting members 50, 51 and 52, 53.

Turning to the top assembly 29 and FIGS. 11–14, rail joint 25 includes two side plates 140, 141 integrally connected to U-shaped top member 142. The end of a rail member 23 and 24 is fixedly disposed within the respective catches 143, 144 which are pivotally connected at 145, 146 to the side plates of rail joint 25. Catches 143, 144 have notched latches 147, 148 located at their respective outboard ends.

Hinge arms 149, 150 are split members (see FIG. 11) mounted for rotation on shafts 151, 152 respectively. One end of each hinge arm 149, 150 includes finger 153, 154, respectively, the fingers being adapted to be engaged by corresponding notch latches 147, 148 to lock the hinge arms in the position shown in FIG. 11. The remaining hinge arm end 155 and hinge arm 149 includes a plurality of gear teeth 157 which are adapted to mesh with gear teeth 158 located at the second end 156 of hinge arm 150. The coupling of the hinge arms 149, 150 by the gear teeth causes the rail members fastened to rail joint 25 to function in unison and, most importantly, it precludes one rail member from unlocking while the remaining rail member remains locked. Spring 159, which is illustrated as a wire form spring, is disposed on shafts 151, 152 and serves to bias and maintain hinge arms 149, 150 in a normally closed position whereby fingers 153, 154 engage latches 147, 148 when play yard 10 is in an erected position.

Knob 160 is located at one end of an elliptical-shaped shaft 161 which, in turn, is mounted on shaft 162. Shaft 162 is mounted for rotation at 163, 164 on joint sides 140, 141. Elliptical-shaped shaft 161 is disposed between and adapted to serve as a cam against hinge arm sides 165, 166.

Figure 11:
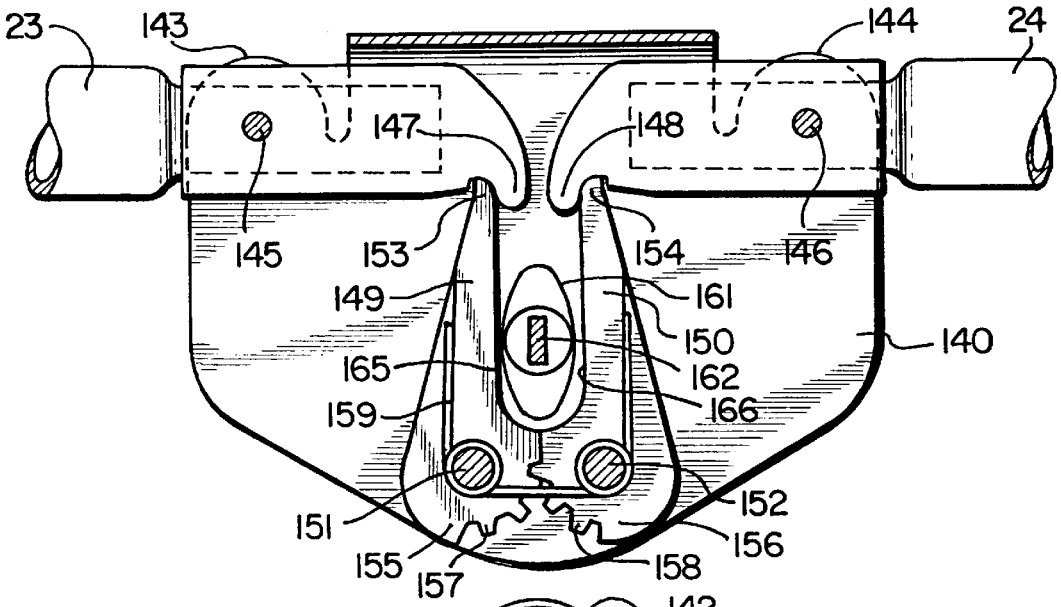
FIG. 11 shows a fragmentary rear section view of a locking rail joint located in the top assembly.
Figure 12:
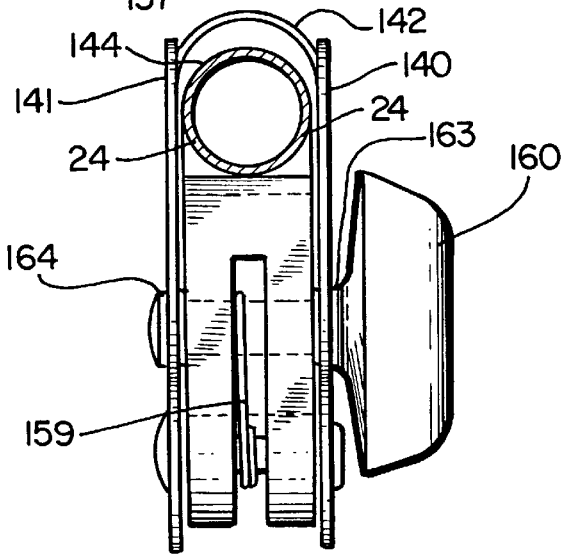
FIG. 12 shows a right end view of the rail joint of FIG. 11.
Figure 13:
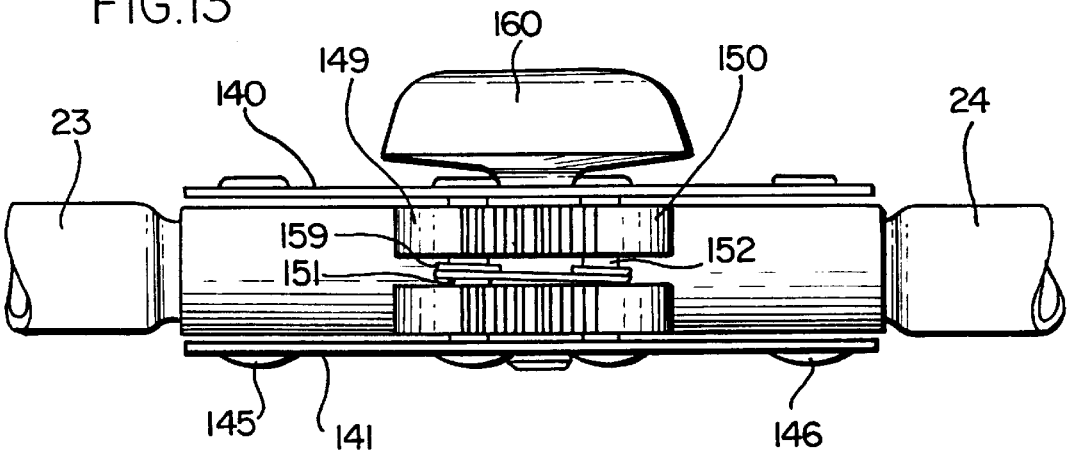
FIG. 13 shows a bottom plan view of the rail joint of FIG. 11.
Figure 14A:
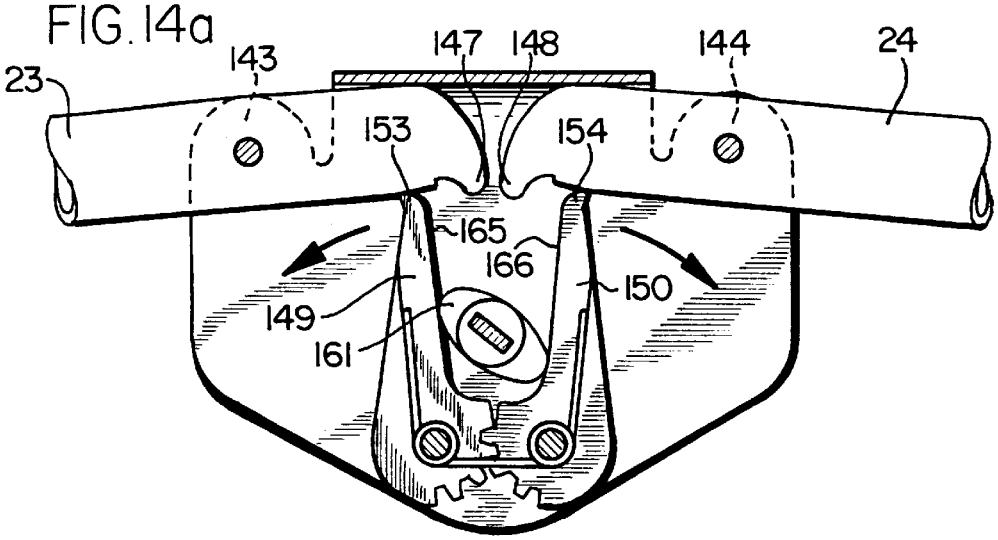
FIGS. 14*a–c* show the incremental collapse of the locking rail joint of FIG. 11.
Figure 14B:
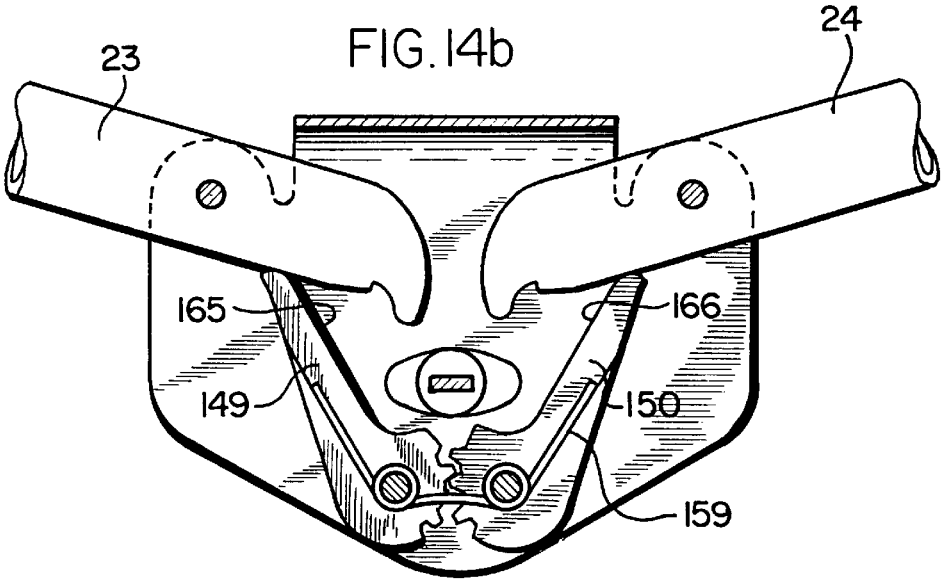

When it is desired to collapse play yard 10, a rail joint 25 is grasped and initially pulled upwardly whereby catches 143, 144 become free to move from the position shown in FIG. 11 to the position shown in FIG. 14*a*. Knob 160 then is rotated, whereupon the elliptical-shaped shaft 161 cams against or otherwise contact the respective sides of the hinge arms as seen in FIGS. 14*a* and 14*b*, causing hinge arms 149, 150 to move outwardly in the direction of the arrows shown in FIG. 14*a* beyond the location of notched latches 147, 148. Once the hinge arms are released from the notched latches, rail members 23, 24 will continue to collapse in a downward position as seen in FIG. 14*c*.

Figure 14C:
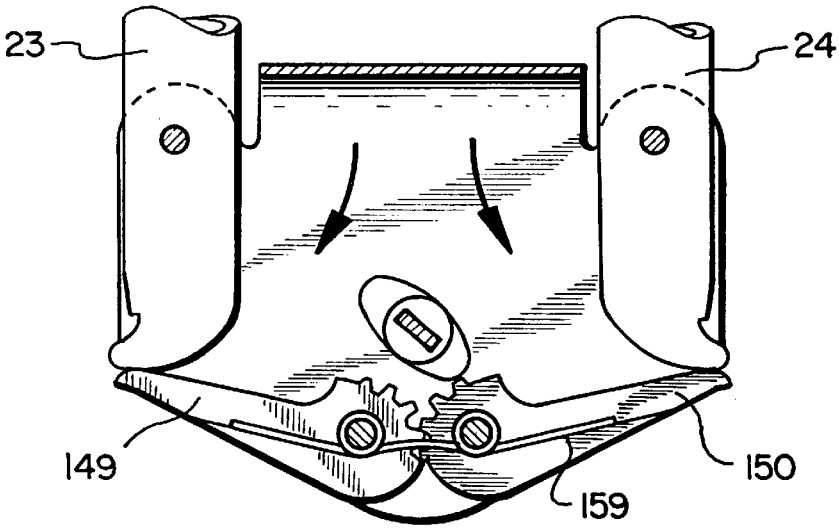

When it is desired to assemble play yard 10 in an erect position, one pulls up on rail member assemblies 20, 21, 22, FIG. 14*c*, thereby allowing hinge arms 149, 150 to return to the position where fingers 153, 154 engage notched latches 147, 148 as illustrated in FIG. 11. Spring 159 assists in biasing and maintaining hinge arms 149, 150 in the normal erected position shown in FIG. 11.

Figure 15:
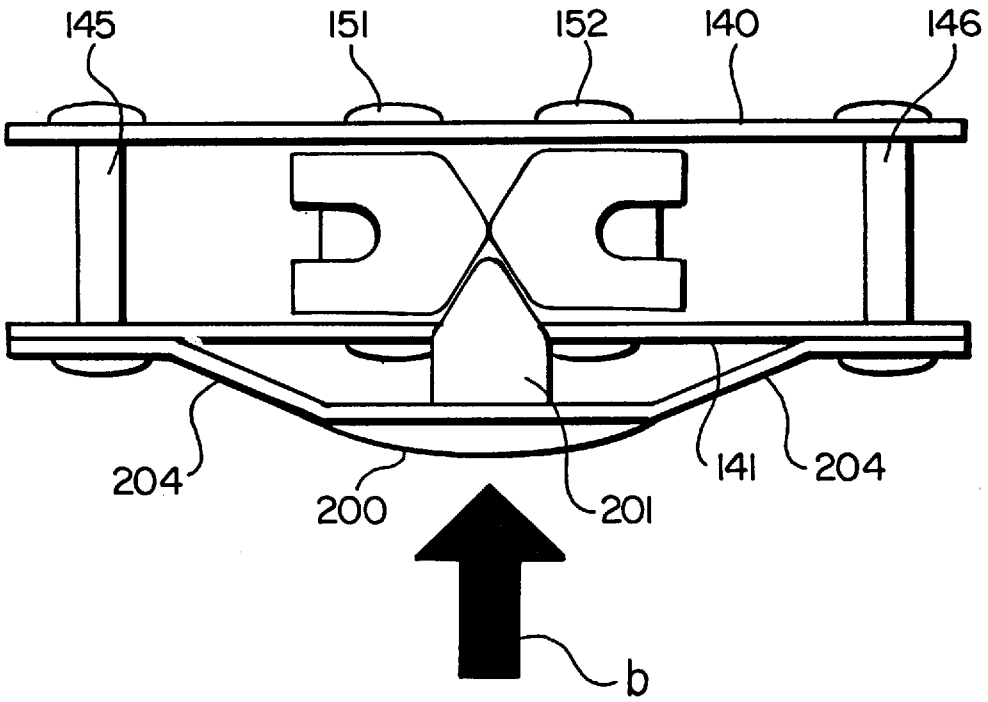
FIG. 15 shows a further embodiment of a locking rail joint utilizing a push button release.

If desired, rotating knob 160 and elliptical-shaped shaft 161 could be replaced by any device which would act to spread or otherwise cause rotation of the catches 143, 144, such as a spring biased button, which is located along a side of rail joint, could be urged inwardly against a suitable compression spring. For example, FIG. 15 shows the locking rail joint of FIGS. 11–14 with knob 160 replaced by button 200 having tapered shaft 201. Button 200 is biased away from rail joint side plate 141 by a suitable compression spring member 204 fixed to side plate 141 whereby button 200 is spaced from side plate 141 as shown in FIG. 15. When it is desired to collapse rail joint 25, button 200 is pushed inwardly in the direction of the arrow "b" in FIG. 15. As button 200 is moved toward plate 141, tapered shaft 201 engages the sides 165, 166 of hinge arms 149, 150 and cams the arms apart as previously described. The locking rail joint configuration can be utilized with any other suitable device designed to cause hinge arms 149, 150 to rotate in the manner shown in FIGS. 14*a–c*.

Figure 6:
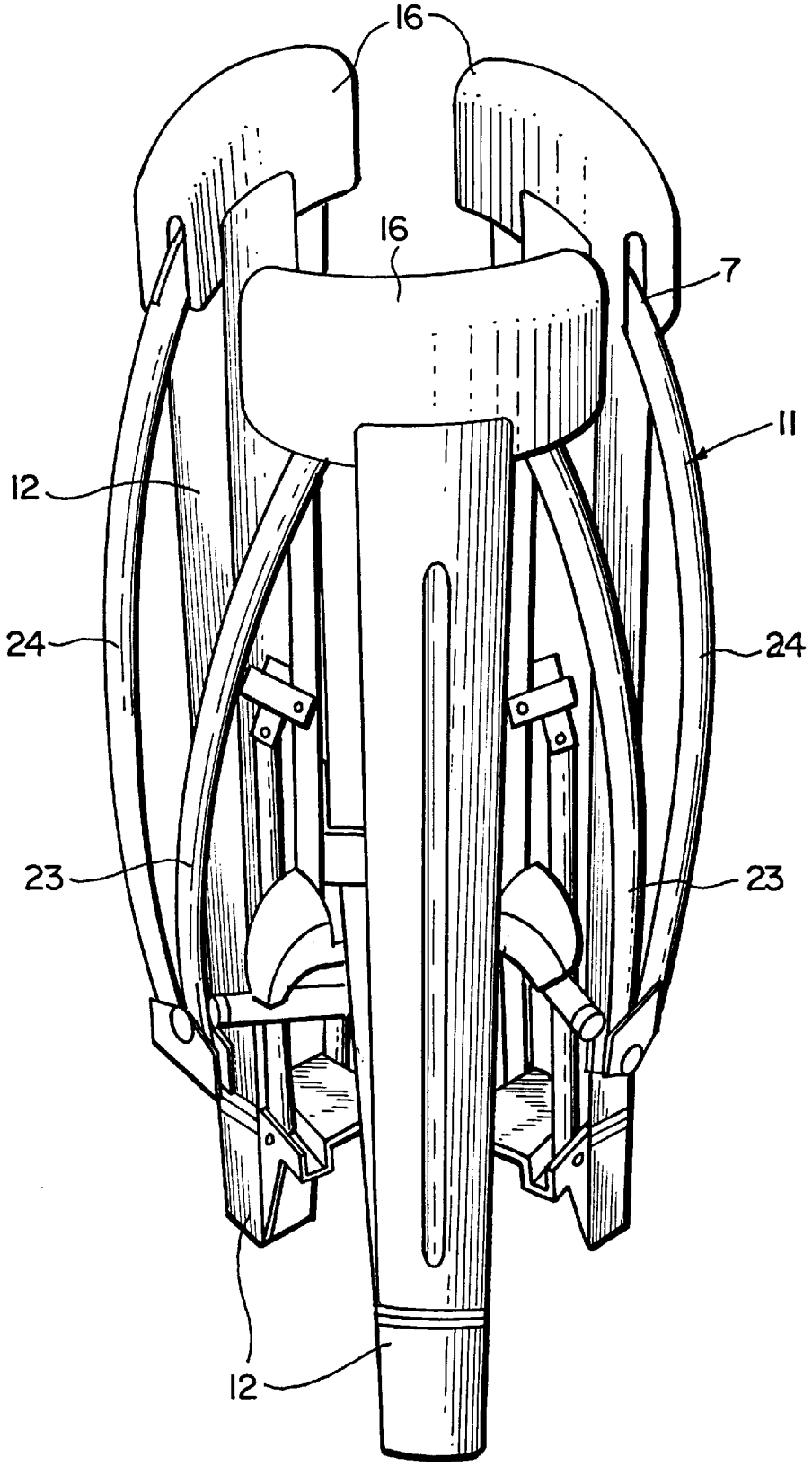
FIG. 6 shows a perspective view of the frame of FIG. 4 collapsed.

To collapse play yard 10 from the erected position shown in FIG. 1, one pulls up on rail joints 25 and cams the fingers to an unlocked position whereupon the top rail assemblies 20, 21, 22 collapse. Then, with the base insert 90 removed from the play yard, upon pulling upward on strap 80, FIG. 10, the leg portions of triangular-shaped subassembly 31 pivot upwardly, FIGS. 4 and 5. The post connection members, i.e., (50, 51), (52, 53), (54, 55) swivel as the leg portions of triangular-shaped subassembly 31 move upwardly. Vertical posts 12 move inwardly, whereupon the play yard assumes the folded, collapsed position illustrated in FIGS. 2, 3, and 6. Subsequently, insert 90 is wrapped about folded play yard 10, FIG. 3, whereupon the folded and wrapped unit can be inserted in a suitable bag-like carrying container.

Figure 17:
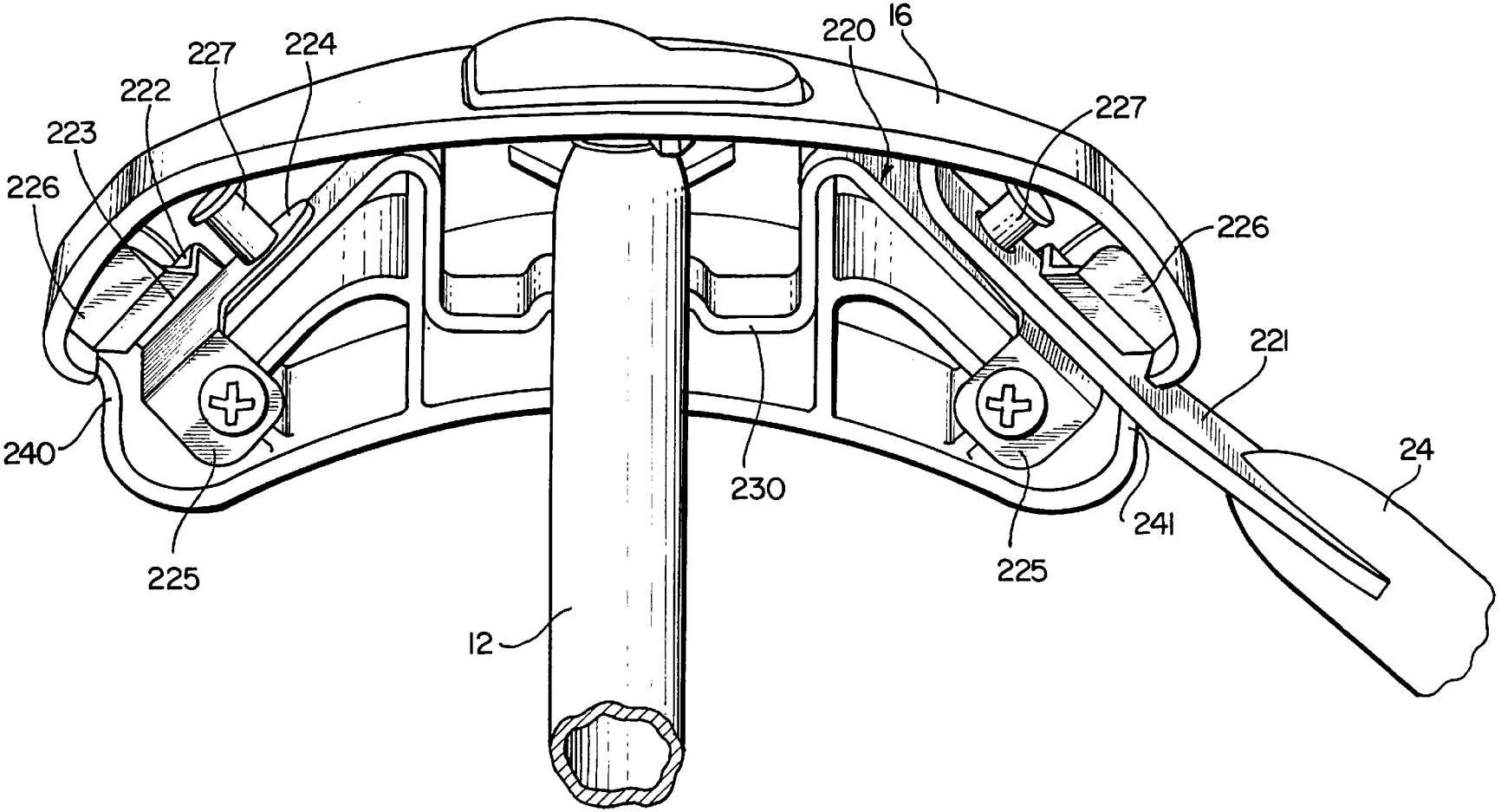
FIG. 17 shows a fragmentary perspective view of the bottom of a vertical post cap assembly.
Figure 18:
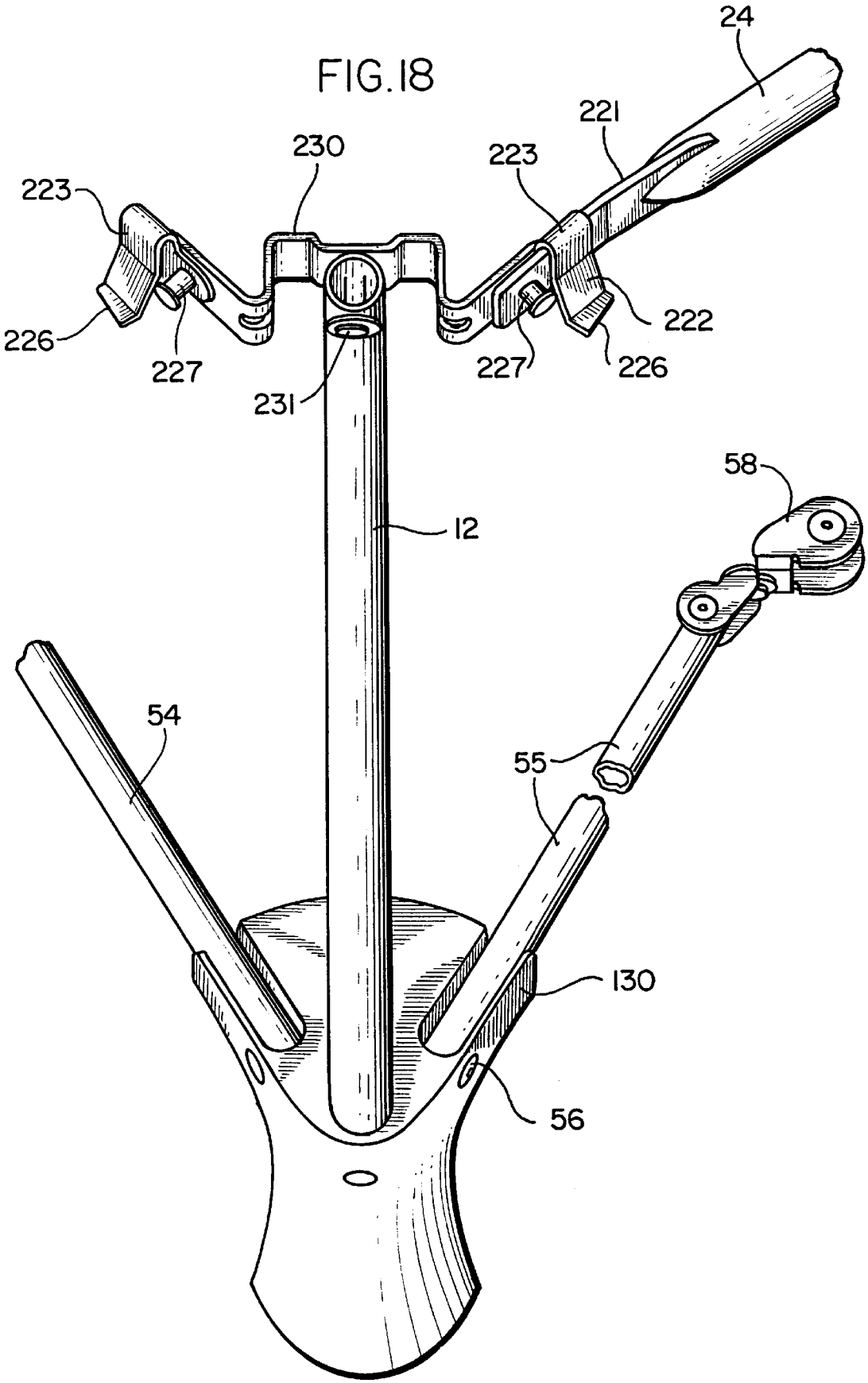
FIG. 18 shows a rail member end connected to a vertical post cap assembly with the cap removed and the rail member in an erected position.
Figure 19:
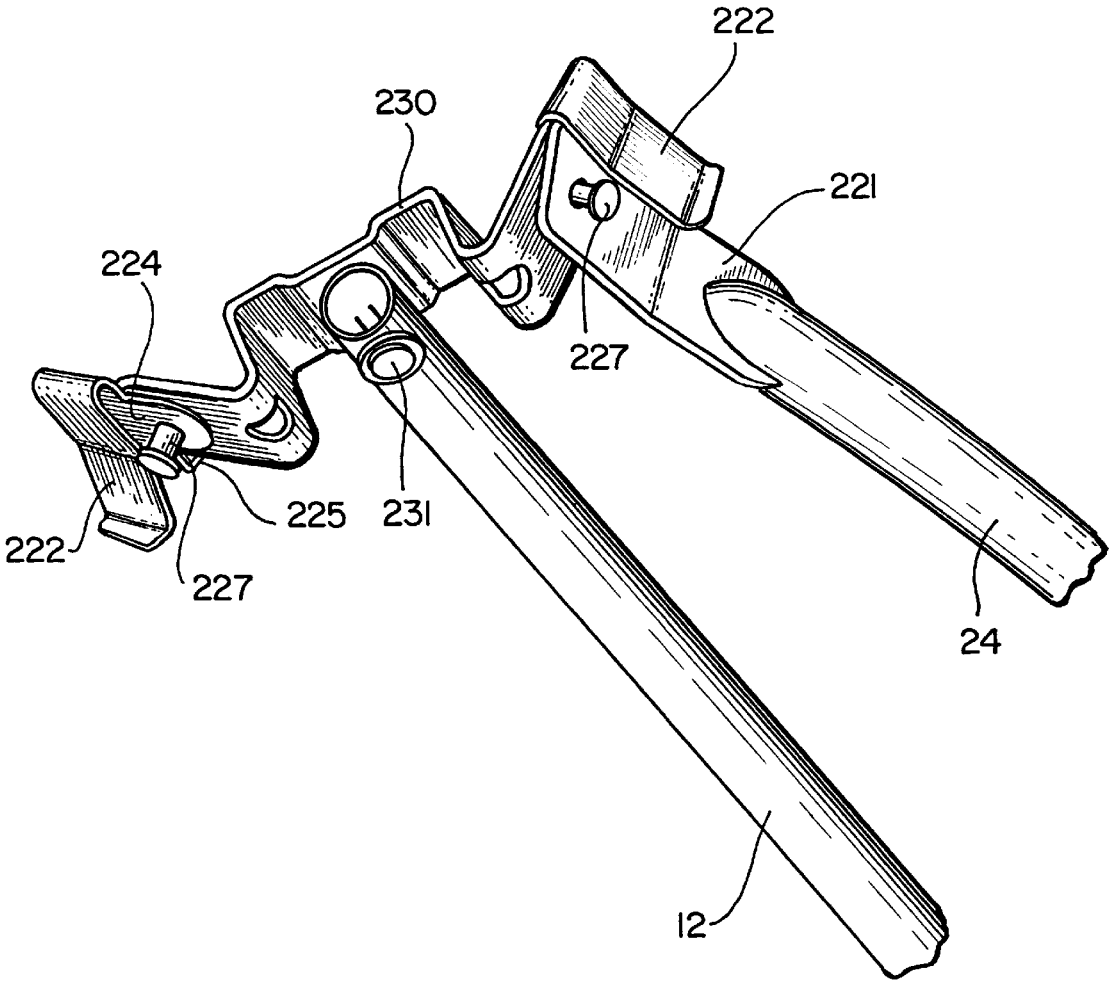
FIG. 19 shows the rail member of FIG. 18 in a collapsed position relative to a vertical post cap assembly.
Figure 19:
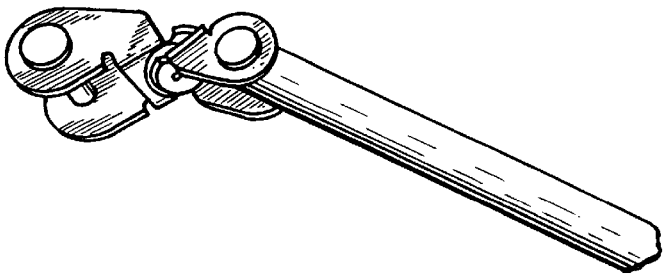
Figure 20A:
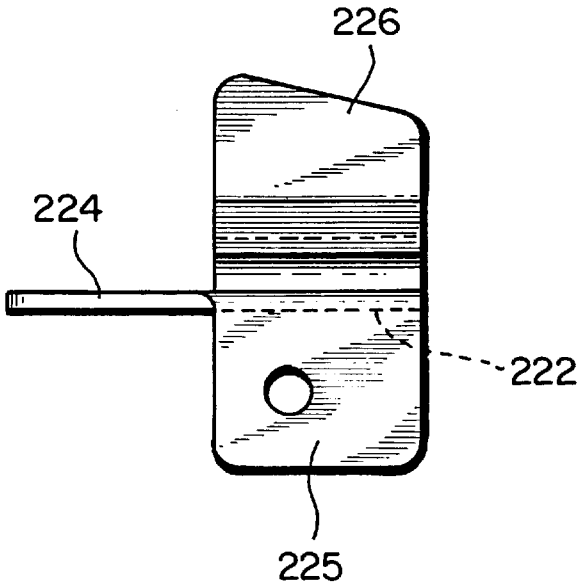
FIGS. 20*a, b,* and *c,* respectively, show the top, front, and side views of a cinch utilized in the vertical post cap assembly of FIG. 18.
Figure 20B:
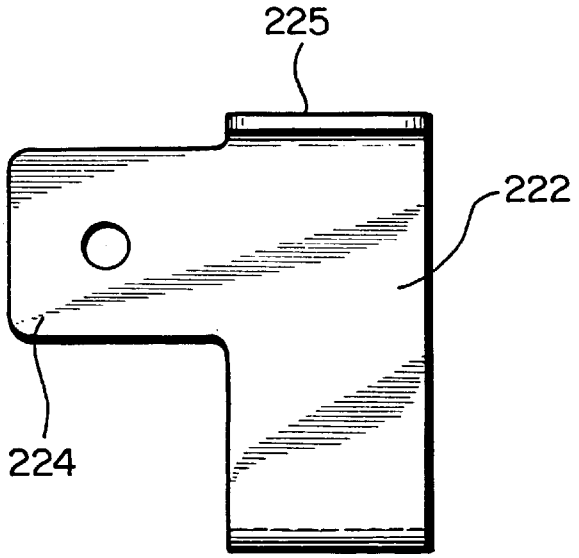
Figure 20C:
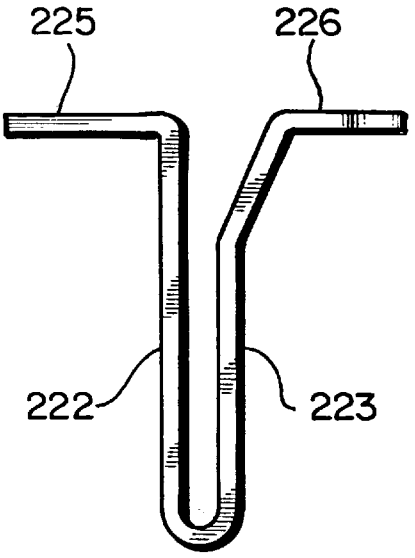

Referring to FIGS. 17–20, rail members 23, 24 each have one end connected to vertical post 12. As seen in FIG. 17, cap 16, which is disposed on post 12, has two slots 240, 241. Cap 16, which has a recessed bottom, encloses assembly 220 which is adapted to connect rail members 23, 24 to vertical post 12. FIG. 17 shows rail member 24 having one end formed to a substantially flat rail end 221 which is adapted to fit within cap slot 241. Rail member end 221 is adapted to be inserted in cinch 222. Cinch 222 includes tapered slotted section 223 and plate extensions 224, 225, 226. The formed rail member end 221 is adapted to seat within the tapered slot section 223. FIG. 17 shows rail member end 221 inserted in slot section 223 whereas the remaining tapered slot section in FIG. 17 is illustrated free of a rail member end. The rail end is pivotally connected to cinch 222 by means of a rivet 227 of a desired length which passes through an opening in end 221, plate extension 224 and corner support brace 230. Corner support brace 230 is adapted to be fastened to vertical post 12 by a suitable fastener such as rivet 231. When a rail member 23 or 24 is in an erect position such as shown in FIGS. 17, 18, the rail members are snugly positioned within slotted cinch section 223 and cap slot 240 or 241. In this position, the rail members are retained from substantial lateral movement. When rail joints 25 are collapsed, however, rail members 23, 24 drop to a position where the flat formed ends of the rail members are no longer positioned within the tapered cinch sections 223 or cap slots 240, 241, see FIG. 19, such that the rail members 23, 24 have a substantial freedom of lateral movement along the length of rivet 227 which serves to assist in collapsing play yard 10.

Figure 16:
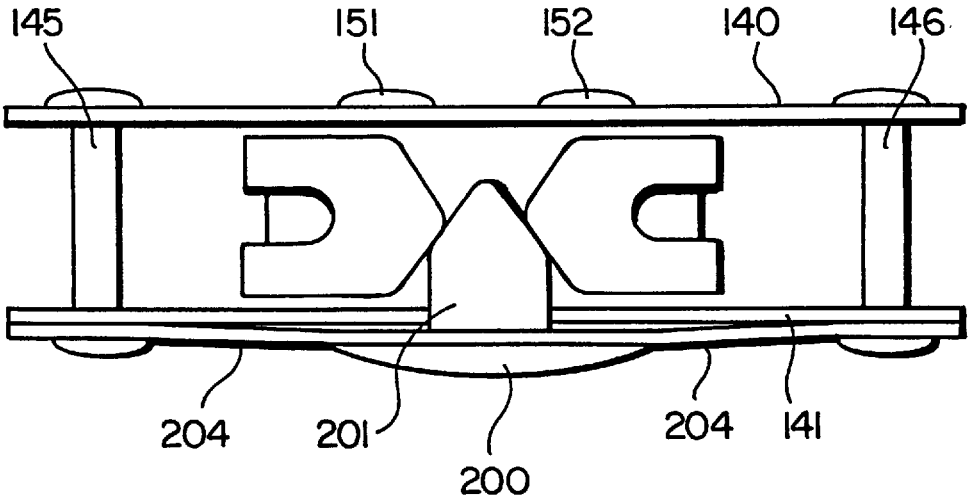
FIG. 16 shows the locking rail joint of FIG. 15 with the push button pushed inward to engage the joint hinge arms.
Figure 21:
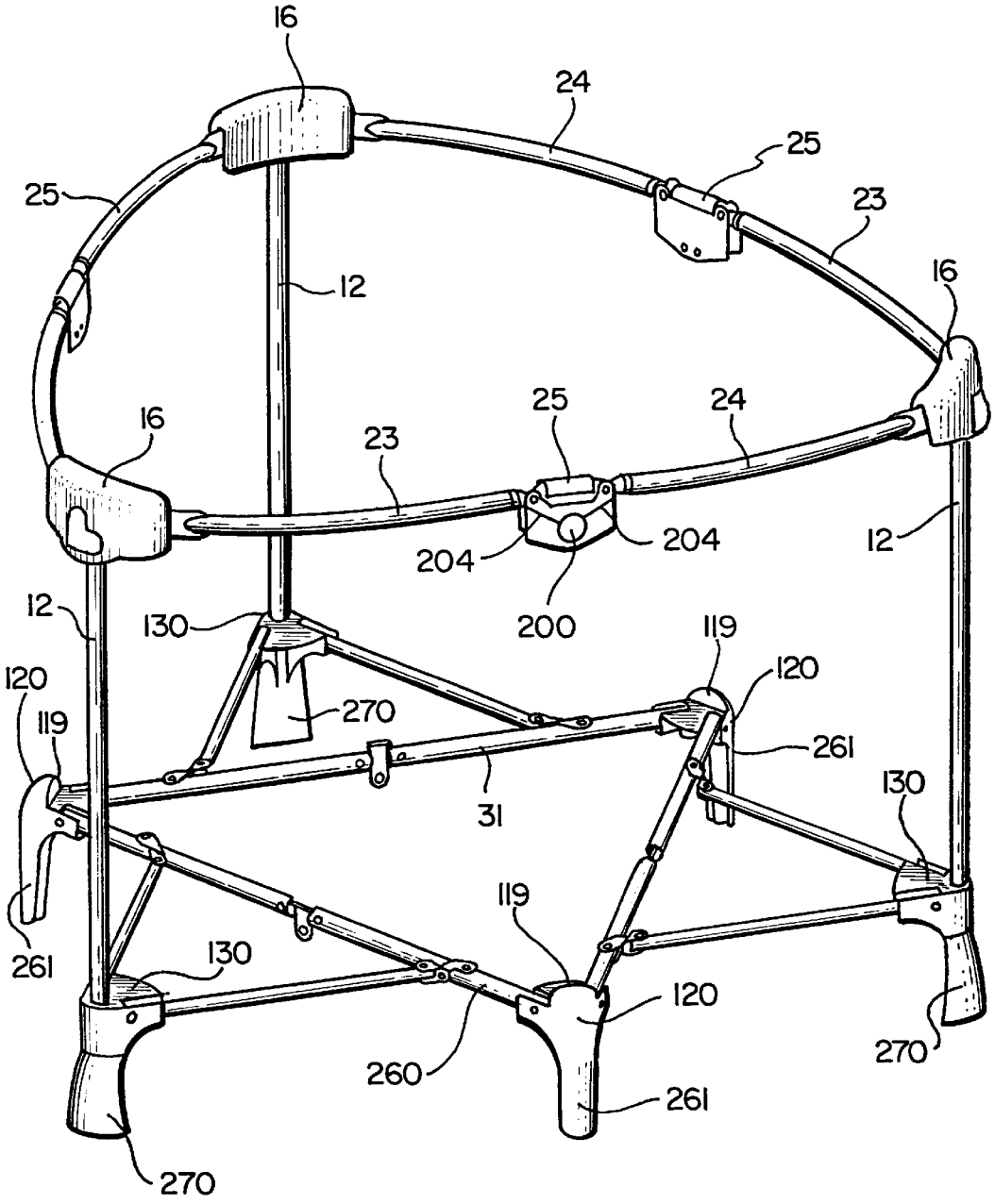
FIG. 21 shows a second embodiment of the play yard frame of the present invention in an erected position.
Figure 22:
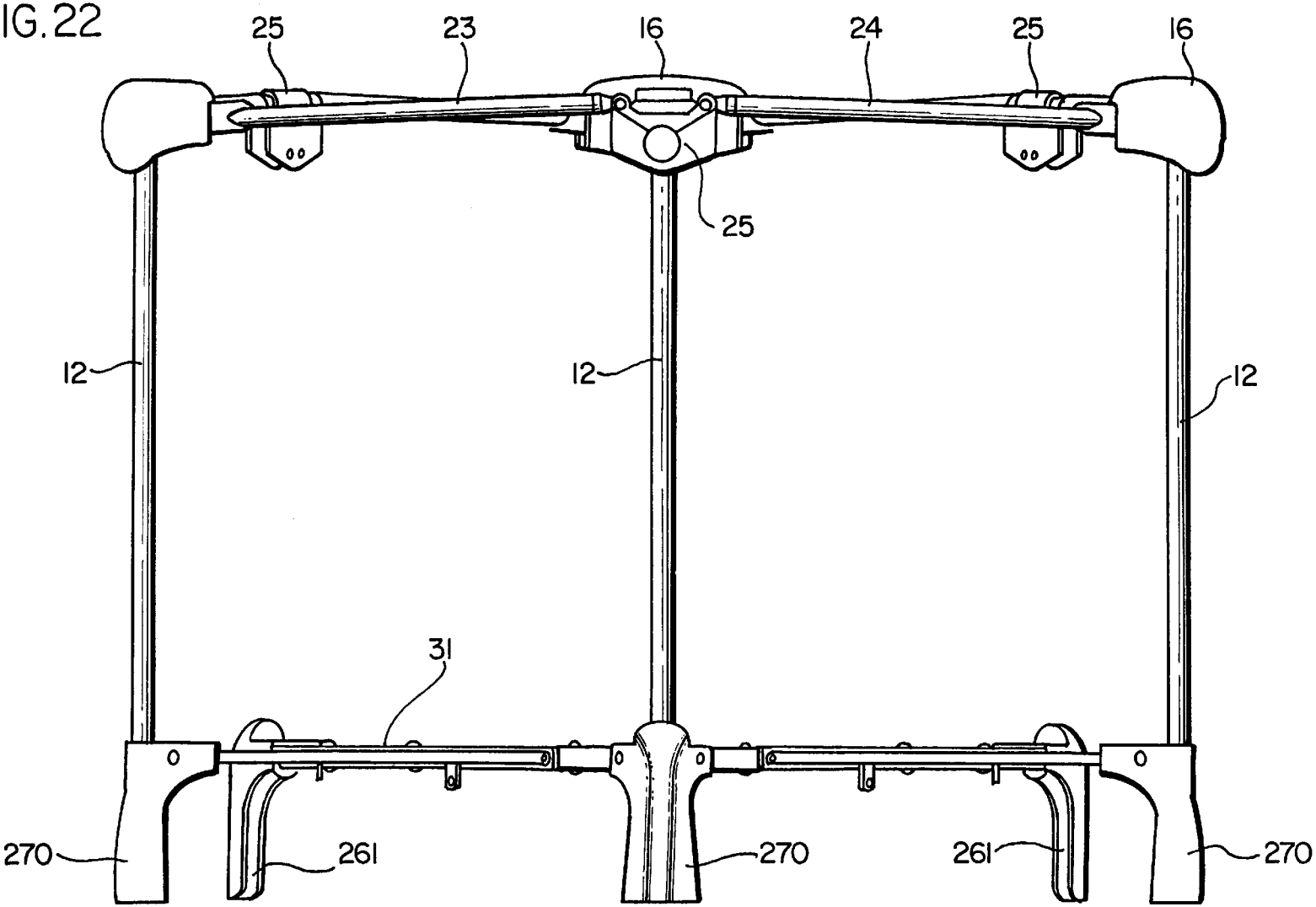
FIG. 22 shows a side view of the play yard frame of FIG. 21.
Figure 23:
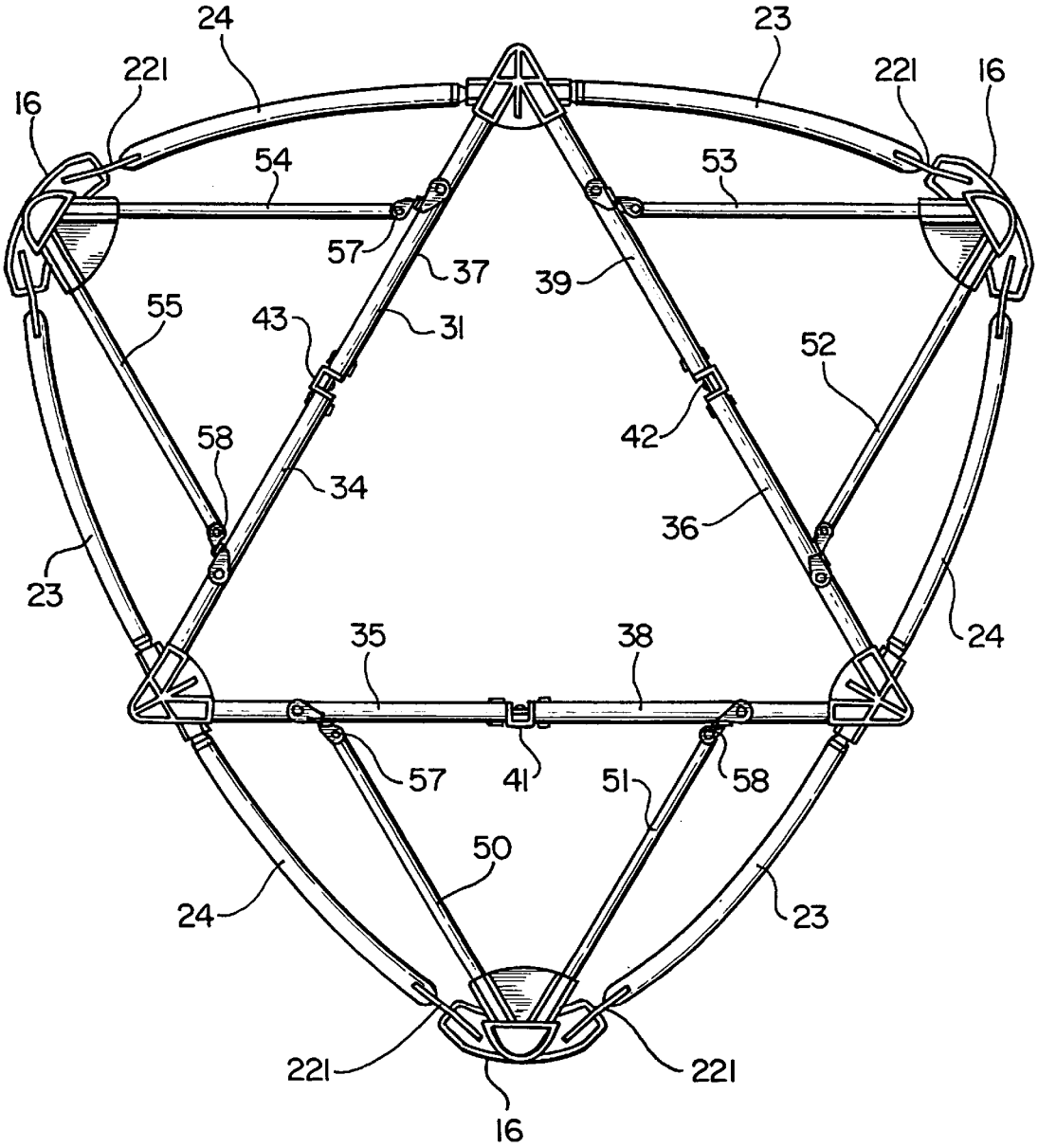
FIG. 23 shows a bottom plan view of the play yard frame of FIG. 21.

FIGS. 21–23 show a further embodiment of the play yard of the present invention. In this embodiment, vertical post 12 comprises tubular members as opposed to employing a cowling or hollow molded column as illustrated in FIG. 1. The locking rail joints 25 employ the push button embodiment disclosed in FIGS. 11, 15, and 16 while the cap assemblies 16 utilize the cinches disclosed in FIGS. 17–20 to connect rail members 23, 24 to vertical posts 12.

Collapsible bottom assembly 260 includes pedestals 120 having stabilizer feet 261 depending therefrom. Base stop 119 is integral with pedestal 120. The bottom end of vertical post 12 includes a foot pad 270 which is connected to and depends from pedestal 130. The triangular subassembly 31 and post connecting members form a truss comprising the truss segments previously described.

The frame of the play yard of the present invention can be made of any suitable metal, plastic or fiberglass material or mixtures thereof.

Moreover, while the truss arrangement disclosed herein has been illustrated with a three-sided play yard, it is appreciated the truss could be utilized with multi-sided play yards. For example, a five-sided play yard could be employed in which various stabilizer feet and truss segments could be developed to carry various loads acting on the play yard. A collapsible pentagonal subassembly would be utilized in place of the triangular-shaped subassembly 31 and truss segments formed by the post connecting members and subassembly legs could be utilized as required.

Similarly, while a triangular-shaped subassembly and truss segments have been shown, it is appreciated that other shapes for the embodiment of FIG. 1 could be utilized without departing from the spirit of the invention. For example, it is expected a collapsible round, concave or convex shape subassembly could be utilized. Similarly, the post connecting members could be curved, as required, the requirement being that the truss segments must serve, in conjunction with the subassembly, as a truss to support the desired loads.

Further, the top assembly has been illustrated with bowed members. It is appreciated that the rail members could be straight or otherwise shaped without departing from the spirit of the present invention.

Figure 24:
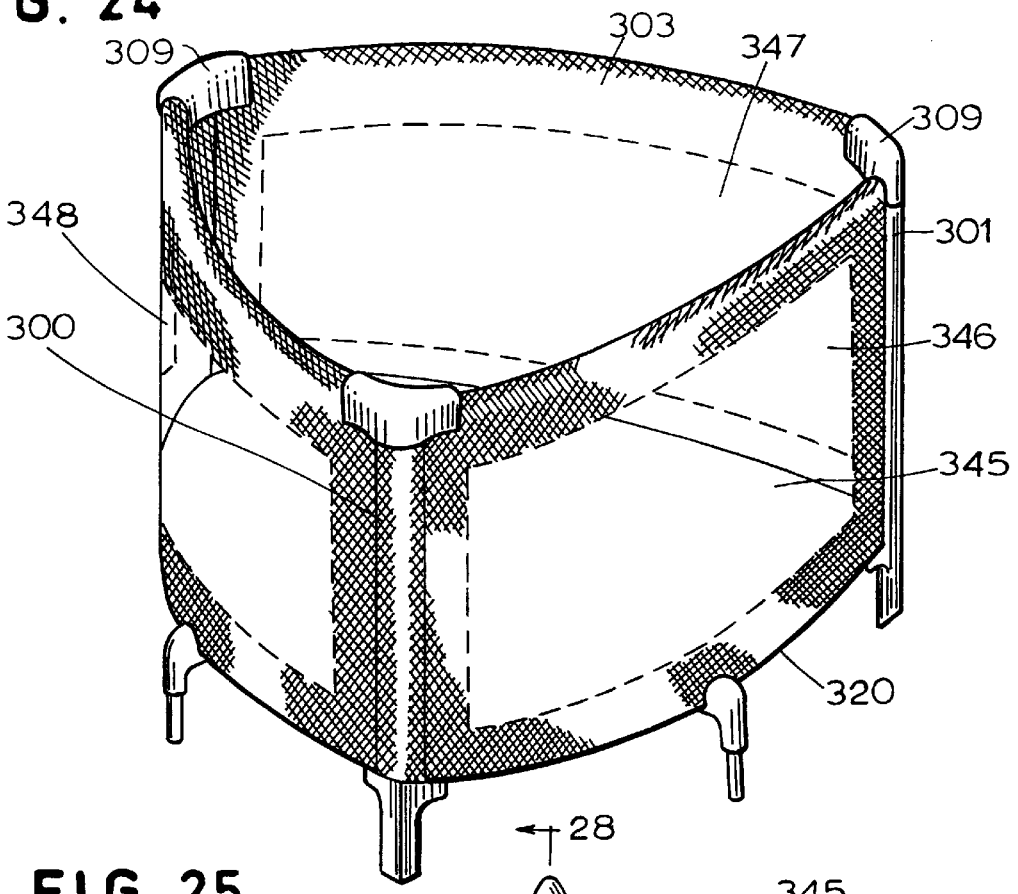
FIG. 24 shows a perspective view of a third embodiment of a three-sided play yard of the present invention in an erected use position.
Figure 26:
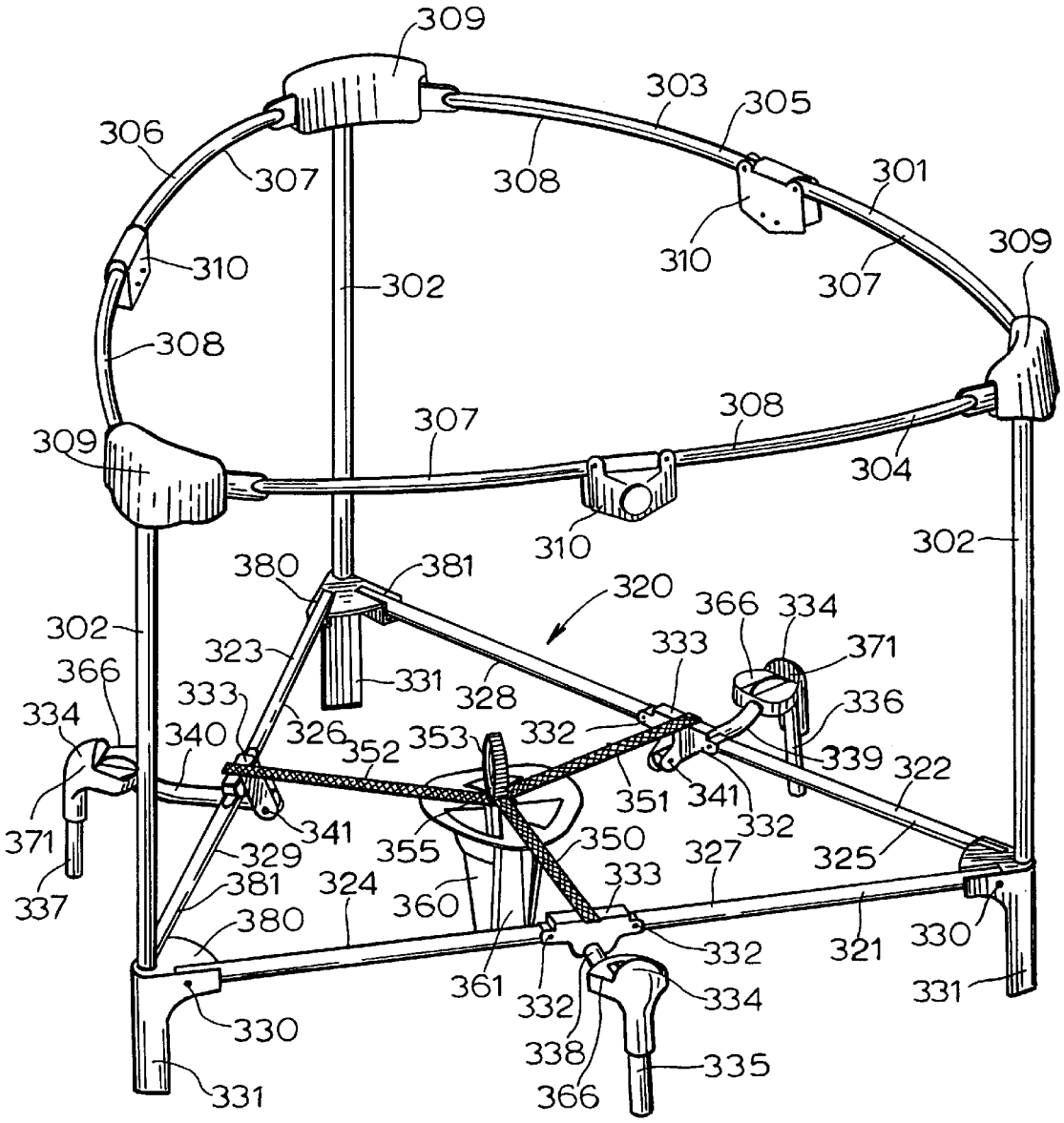
FIG. 26 shows a perspective view of the frame of the play yard embodiment of FIG. 24 with the top assembly and bottom assembly in the erected position.

Referring to the drawings FIGS. 24 and 26, another embodiment of a play yard 300 of the present invention comprises frame 301. Frame 301 includes three vertical posts 302, each post having an upper and lower end.

A collapsible top assembly 303 includes top rail assemblies 304, 305, 306 each comprising first and second rail members 307, 308. The top assembly and rail joint members are the same as previously disclosed herein for the play yard embodiments disclosed in FIGS. 1–23.

The rail members preferably are slightly bowed to provide a curved configuration such as shown in FIG. 26. Each rail member has one end pivotally connected to a vertical post 302 and a second end pivotally fastened to a locking rail joint 310 as previously described with respect to the play yard embodiments of FIGS. 1–23 and will not be repeated herein, but the disclosure of which is incorporated by reference. Cap assembly 309 is disposed over the top end of each post 302 and encloses the pivotal connection between a post and corresponding rail members.

Each rail joint 310 and its operation is identical to the rail joint 25 previously described with respect to the embodiments of FIGS. 1–23 and will not be repeated here, but the disclosure of which is incorporated by reference. The rail members fastened to rail joint 310 function in unison and, most importantly, the rail joint precludes one rail member from unlocking while the remaining rail member remains locked. A spring 159 in each rail joint serves to bias and maintain the rail members in a normally locked position when play yard 300 is in an erected position.

Knob 160 or button 200 (FIGS. 12–16) located in each rail joint 310 is mounted for rotation or to be pushed. In collapsing play yard 300, each rail joint 310 is grasped and initially pulled upwardly whereby catches in the rail become free to move from a locked to an unlocked position. Knob 160 is rotated or button 200 is pushed, whereupon the latches are released and the rail members 307, 308 will collapse in a downward position. In assembling play yard 300 to an erect position, one pulls up on rail member assemblies 304, 305, 306 thereby allowing engagement of the latches in the rail joint 310, which includes spring 159 to assist in biasing and maintaining a latched condition in the normal erected position shown in FIGS. 24 and 26.

Cap 309, which has a recessed bottom, is the same as described previously with respect to the play yard embodiments of FIGS. 1–23 and is adapted to connect rail members 307, 308 to a vertical post 302. Each rail member is pivotally connected to cap 309, as previously described for the embodiments of FIGS. 1–23 and in an erected position, the rail members are retained from substantial lateral movement. Caps 309, however, permit rail members 307, 308 to have a substantial freedom of movement which serves to assist in collapsing play yard 300.

The bottom assembly 320 of play yard 300 includes a collapsible three-sided assembly which preferably is in the form of an equilateral triangle. The triangle legs 321, 322, and 323, each include first leg portions 324, 325, and 326 and second leg portions 327, 328, and 329.

One end of each leg portion forming a leg, e.g., portions 324, 327 of leg 321, is pivotally connected at 330 to a post pedestal 331 mounted to the bottom end of each vertical post 302. The remaining end of each leg portion, e.g., portions 324, 327 of leg 321, is pivotally connected at 332 to a multiple pivot joint member 333.

Stabilizer foot pedestal 334 is located adjacent each of the multiple pivot joint members 333. Stabilizer feet 335, 336, 337 and members 338, 339, 340 each depend from a stabilizer foot pedestal 334. One end of each tubular member is connected to a stabilizer foot pedestal 334 and the opposite end pivotally connected at 341 (FIG. 29) to a respective multiple pivot joint member 333.

Each stabilizer foot is located away from the vertical center axis of the play yard and preferably is located at a point which is beyond a vertical plane which intersects the vertical axes of the vertical posts 302 which are adjacent a stabilizer foot. A stabilizer foot preferably is equally spaced from adjacent vertical posts 302 such that three stabilizer feet and three vertical posts shown in FIG. 26 effectively stabilize the play yard when it is in an erected position. The stabilizer feet also can be located at the edge of, or more preferably beyond the maximum outer periphery of the top assembly, bottom assembly or base insert whichever outer perimeter is the largest.

It also is preferred to have vertical load support straps 450 (FIGS. 25, 27) connect adjacent legs 321, 322 and 323. The straps are flexible, cloth or plastic members which can be riveted, stapled or otherwise fastened to a leg. Each strap connects to a pair of adjacent legs and is adapted to fold upon collapse of the frame as shown in FIG. 27.

Figure 25:
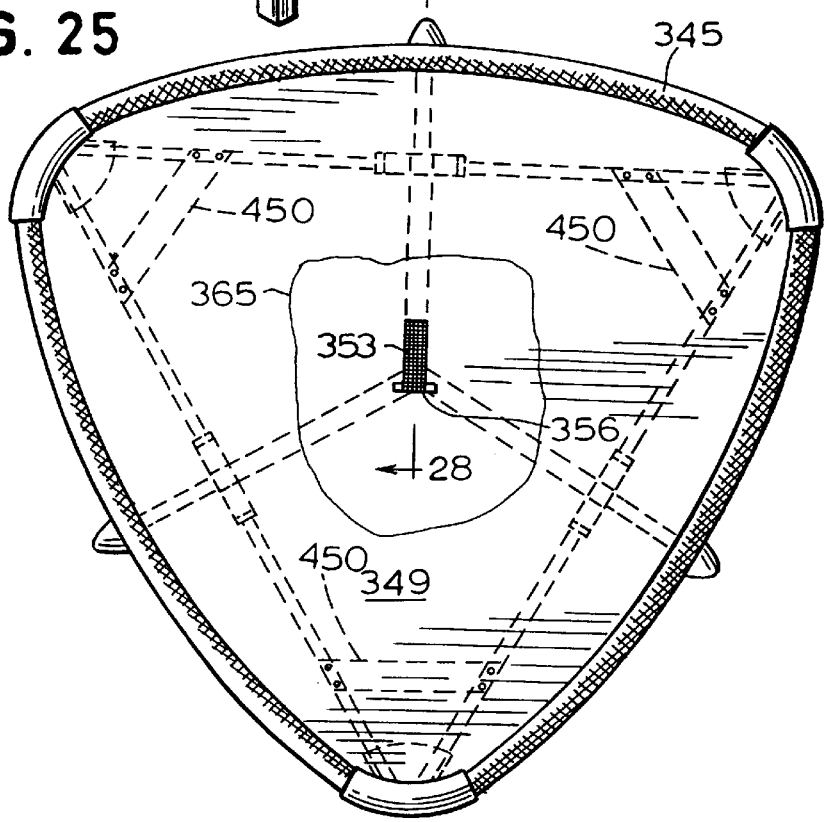
FIG. 25 shows a top plan view of the play yard embodiment of FIG. 24 with the base insert partially fragmented and vertical load support straps.

Referring to FIGS. 24 and 25, panel assembly 345, which is made of a conventional cloth, plastic, or fabric, is disposed on frame 301. Assembly 345 includes three side panels 346, 347, 348 and bottom panel 349. In the same manner as previously discussed with the play yard embodiments of FIGS. 1–23, the top of each side panel member is disposed over respective rail members 307, 308 and rail joint 310, and stitched or formed to form a sleeve which encloses the rail members and rail joint. The side panels, which also can include a mesh material, if desired, drape downwardly. Bottom panel 349 is stitched or otherwise attached to the bottom edge of each of the three side panels. Further, the bottom panel is stitched, riveted, stapled, or otherwise attached to each stabilizer foot pedestal 324 such that when the play yard is in an erected position, the base panel normally seats in a relatively loose manner on top of bottom assembly 320. See FIG. 30. As opposed to stapling the stabilizer foot pedestals to the bottom panel, it is preferred to have a first flexible cloth or plastic strap 460 with one strap end 461 stitched or otherwise fastened to the bottom surface of panel 349 and the other strap end 462 looped through an opening 463 in foot pedestal 334 (FIG. 35).

Figure 27:
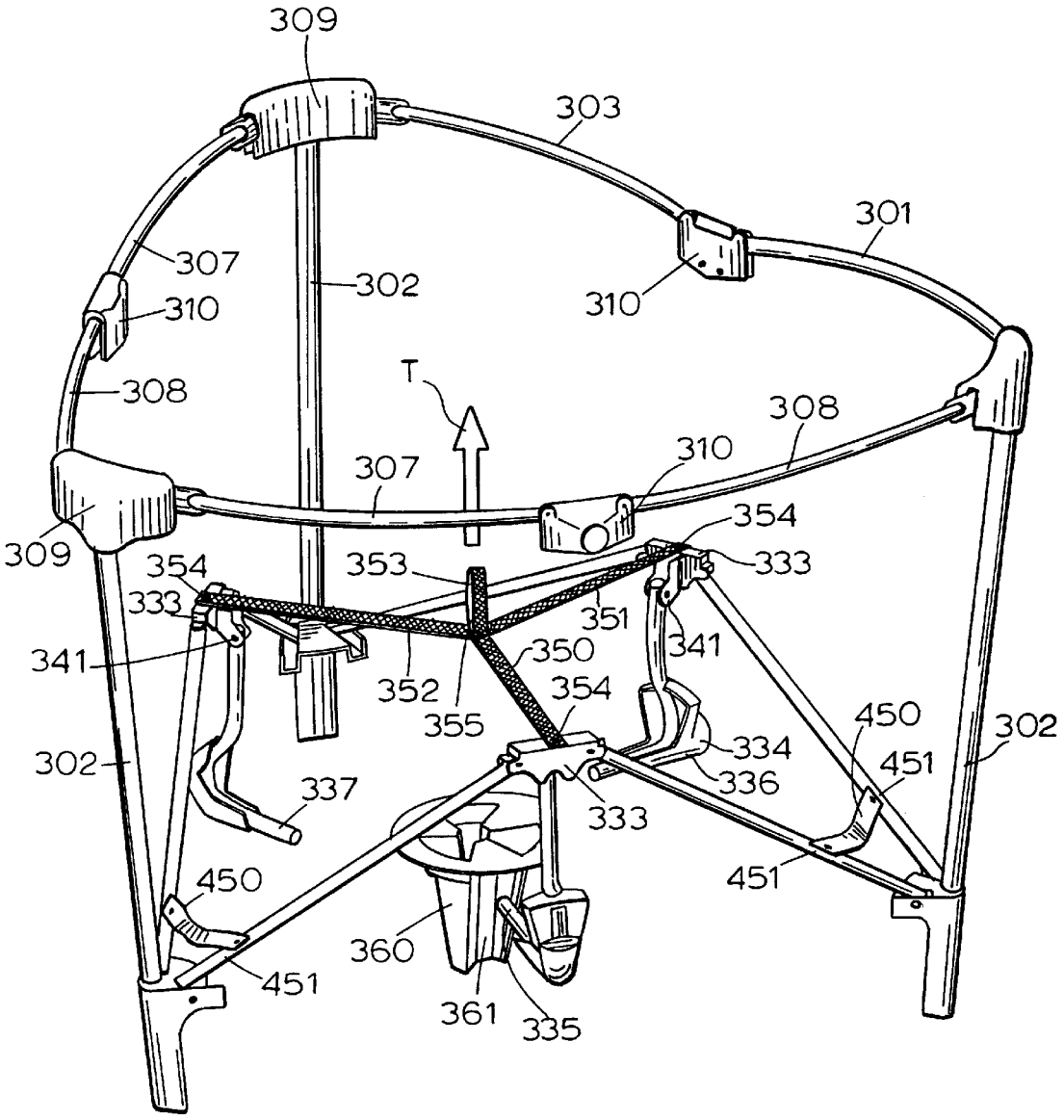
FIG. 27 shows a perspective view of the play yard of FIG. 24 with the top assembly and bottom assembly, each in a partially collapsed position.

Plastic, cloth, or otherwise flexible web straps 350, 351, 352 can be, as shown in FIGS. 26, 27, suitably fastened at one end to the top of respective multiple pivot joint members 333 and at the other end to a web strap loop 353. The web straps are mounted independent of the bottom panel 349 in that they are not attached to the bottom panel. While straps 350, 351, 352 are shown as extending substantially horizontally across the outer or bottom surface of bottom panel 349, FIG. 26, it is appreciated these strips or straps can be disposed in a non-horizontal or relatively loose or limp position.

Figure 35:
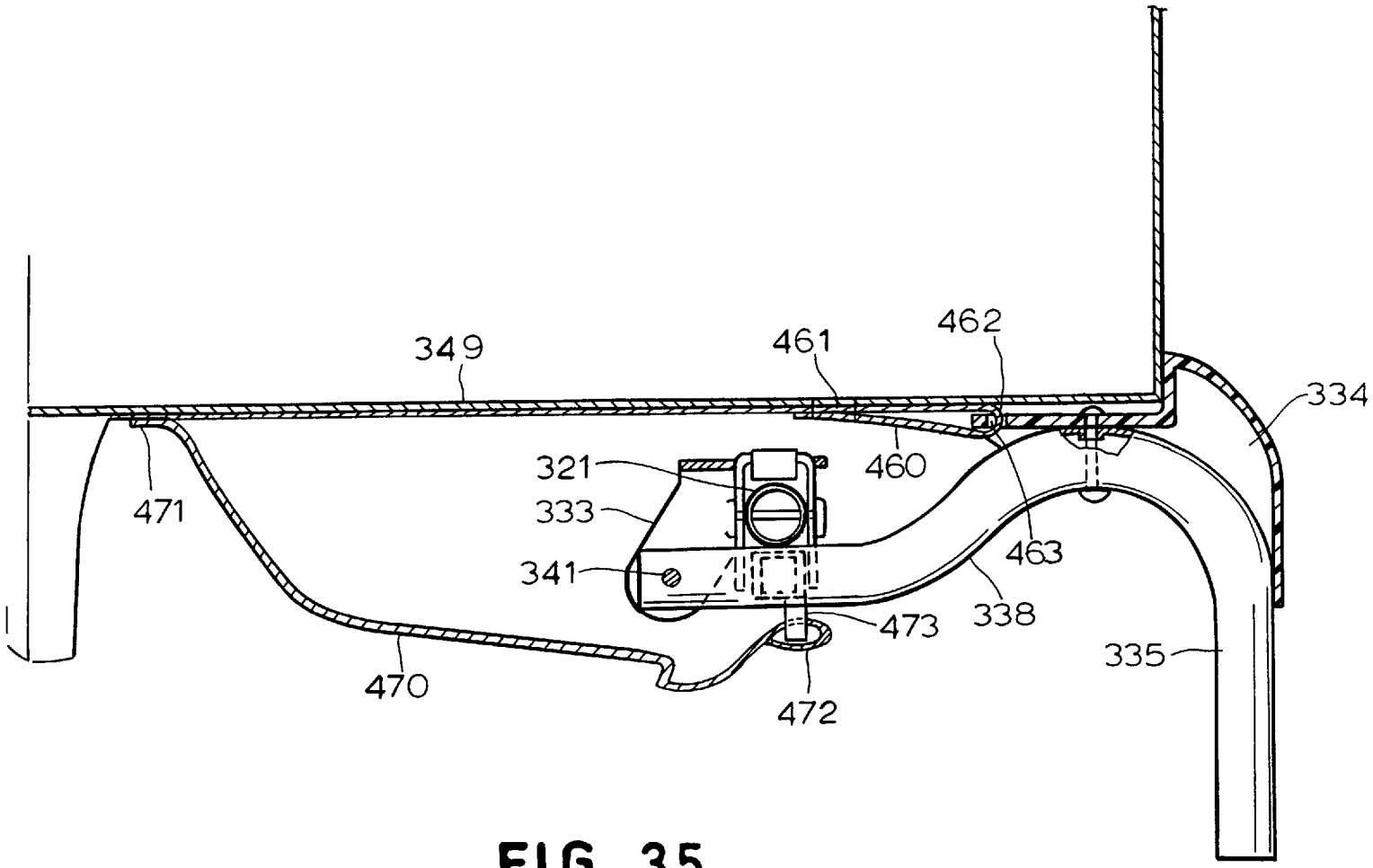
FIG. 35 shows a partial fragmentary side section view of straps utilized to assist in opening and collapsing a stabilizer foot.

If desired, and most preferred, a loose fitting, flexible strap 470, FIG. 35, is fastened in any suitable manner at one end 471 to the bottom surface of bottom panel 349 contiguous to pylon 360 while the remaining strap end 472 is connected to collar bracket 473 attached to collar 474 which is disposed on the outboard end of each tubular member 338, 339, 340.

Figure 28:
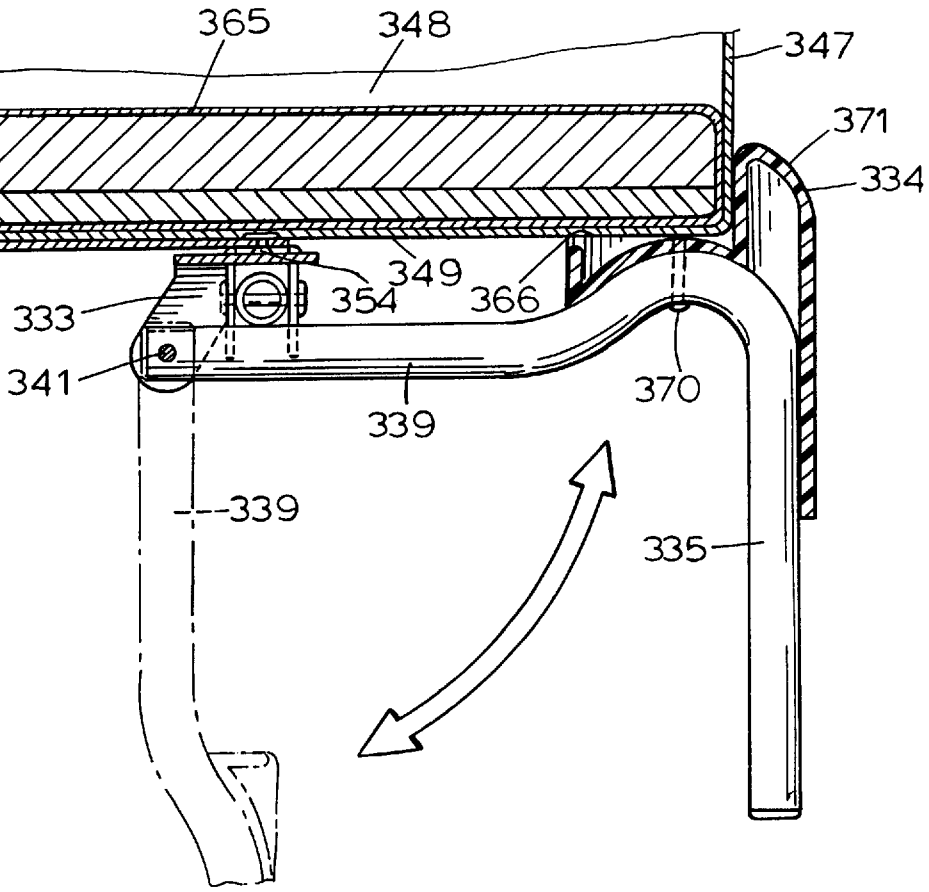
FIG. 28 shows a fragmentary, sectional view taken along section line 28—28 of FIG. 25.
Figure 29:
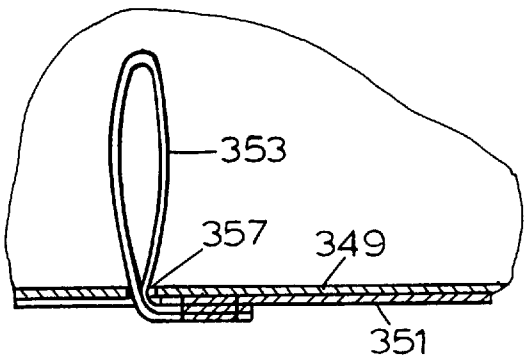
FIG. 29 shows a fragmentary, sectional view of a web loop utilized for collapsing the play yard of FIG. 24.

Referring to FIGS. 26, 28 and FIG. 29, web strap 351 is suitably fastened to the top of multiple pivot joint member 333 by means of a conventional rivet or staple 354. The other end of web strap 351 is connected to the other web straps 350, 352 at stitch connection 355 where there is formed the web strap loop 353. A suitable slit aperture 357 in bottom panel 349 enables the web strap loop 353 to pass through the aperture and normally lie on the top or upper surface of panel 349 when insert base 365 is inserted in the play yard (FIG. 29). A support pylon 360 having a plurality of recesses 361 is stapled or stitched to the bottom surface of bottom panel 349 at about the location of the central vertical axis of play yard 300.

Strap 460 serves to assist in pulling a stabilizer foot 335, 336 or 337 into position upon opening or erecting the play yard. Strap 470 serves to assist in collapsing a stabilizer foot upon folding or closing the play yard.

The vertical loading on the play yard is supported by the posts, stabilizer feet, load support straps, and pylon. Base insert 365, FIG. 28, is adapted to be inserted within the play yard when it is in an erected position. Insert 365 serves both as the play yard floor and further to maintain bottom panel 349 in a relatively substantially taut position. Preferably, insert 365 comprises a flexible foam or fabric pad over which is stretched or mounted a conventional plastic or cloth fabric material. As discussed previously with the embodiments of FIGS. 1–23, the insert is formed into four discrete sections, the insert sections being foldable relative to one another at the location of the fold lines. When play yard 300 is in an erected, in use position, as shown in FIG. 24, insert 365 seats on top of the inner surface of bottom panel 349 which, in turn, is disposed on top of the triangular-shaped bottom or lower assembly 320 and is configured to contact the lower inside surfaces of side panels 346, 347, 348. Support pylon 360 assists in supporting the center of the base insert.

Figure 3:
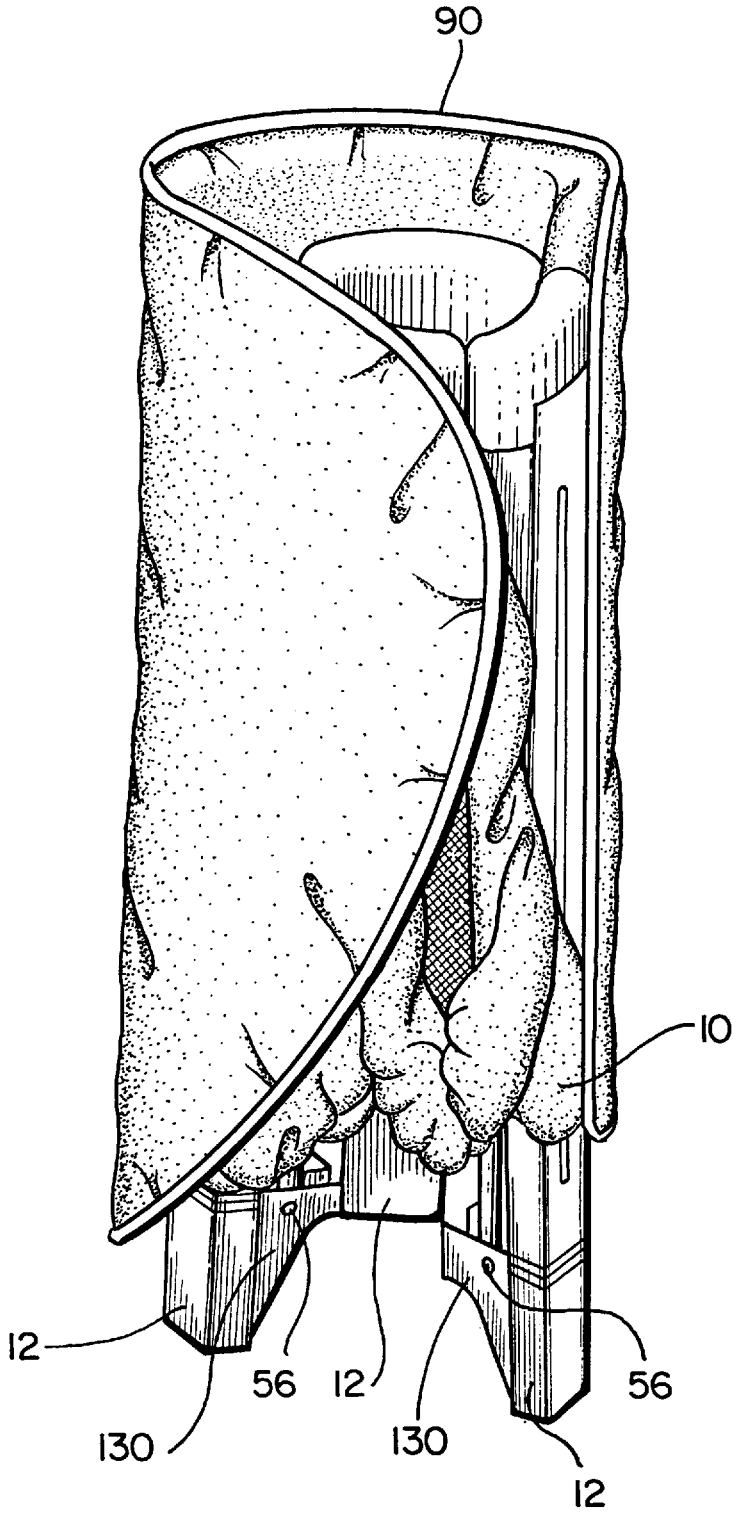
FIG. 3 shows a perspective view of the play yard of FIG. 1 with the play yard in a collapsed position wrapped within the base insert.

Insert 365 while being flexible, also is of sufficient rigidity such that when it is inserted in play yard 300, it assists to position and maintain the side and bottom panels in a relatively taut condition when the play yard is erected as compared to the loose position of the panels when the play yard is collapsed. The base insert also serves to provide a relatively soft floor surface for an infant or child disposed within the play yard. After the play yard is placed in a collapsed position, insert 365 can be utilized as a wrap for enclosing play yard 10 such as illustrated in FIG. 3.

Figure 30:
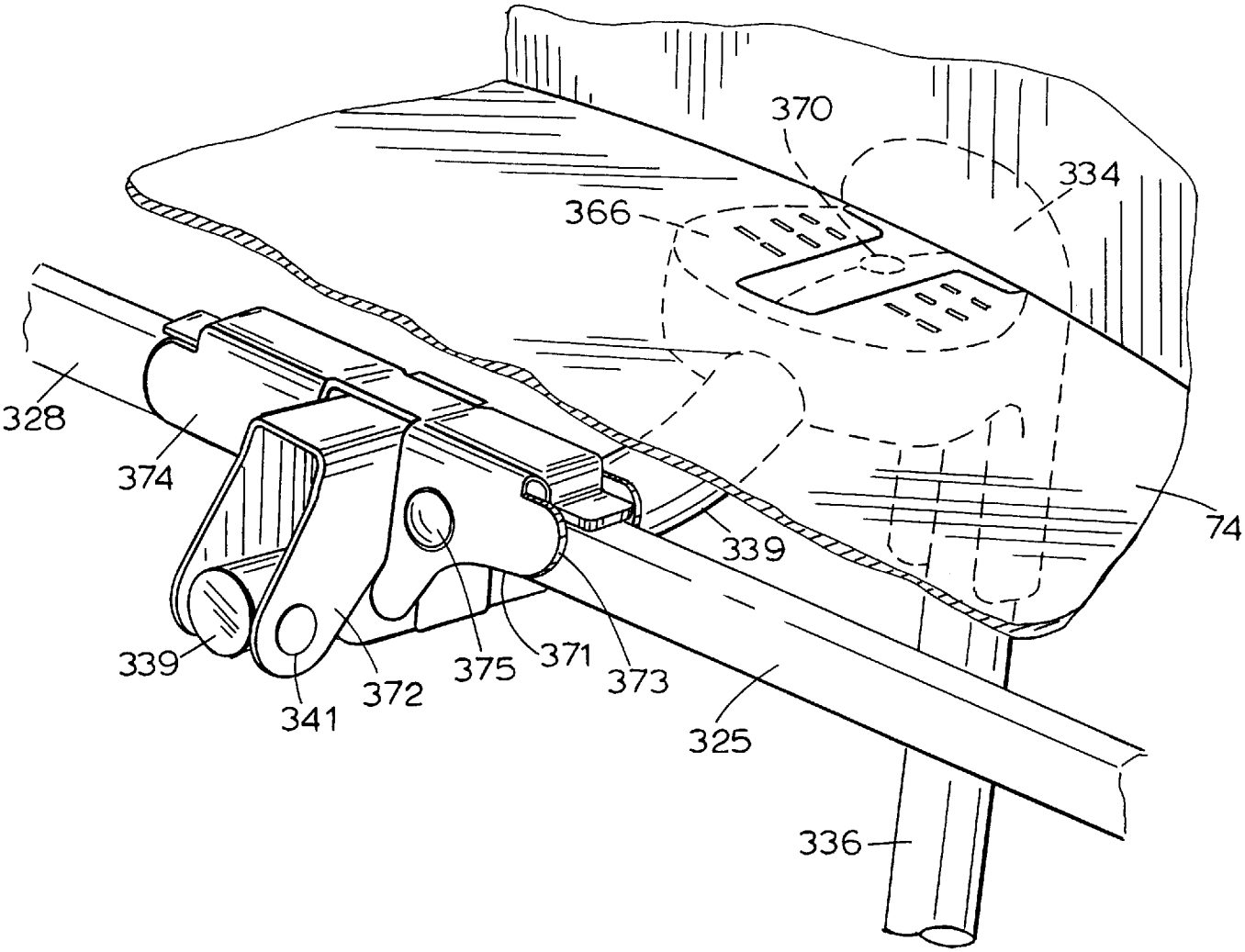
FIG. 30 shows a fragmentary, perspective view of a multiple pivot joint member pivotally connected to leg portions of a triangular-shaped bottom assembly and to a stabilizer foot, the play yard being in an erected position.
Figure 31:
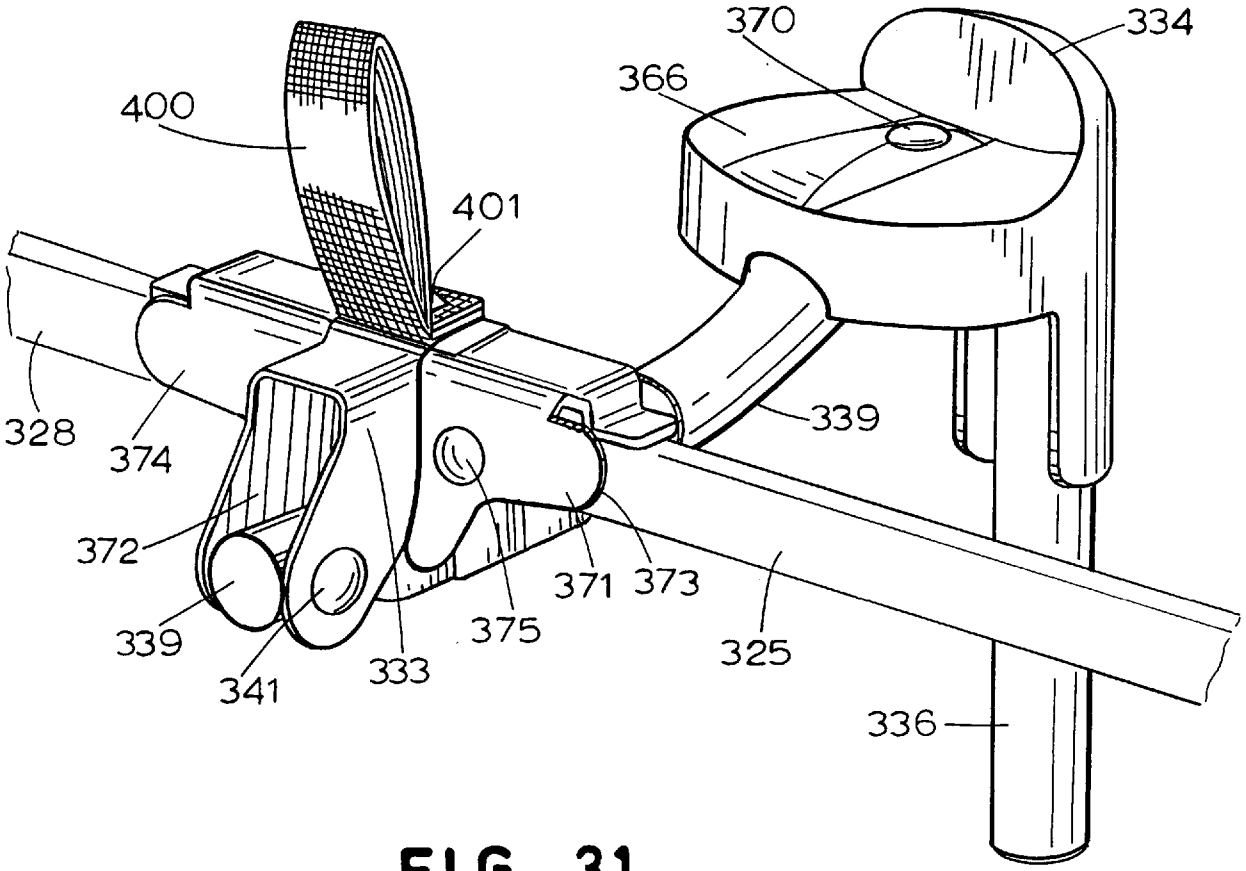
FIG. 31 shows a fragmentary, perspective view of a multiple pivot joint member, with an alternative arrangement for a web loop.

As illustrated, for example, in FIG. 28, each stabilizer foot pedestal 334 includes a pad 366 adapted to receive a convex shaped portion of each tubular member 338, 339, 340. Each tubular member and stabilizer foot pedestal 334 are connected by a rivet 370 or other suitable fastener, as illustrated in FIGS. 28, 30, and 31. Base insert stop 371 is disposed on the top of and integral with stabilizer foot pedestal 334. Stops 371 are adapted to seat against base insert 365 so that, in conjunction with vertical posts 302, base insert 365 cannot be substantially rotated or otherwise moved out of its normal position when the play yard is in its erected position.

Each stabilizer foot pedestal 334 is attached to the bottom surface of panel 349 at or near the location of pivot member 333, FIG. 28. Panel 349 can be glued to pedestal 334 by adhesive or otherwise retained by a suitable fastener, such as a rivet or staple (FIG. 31), so that each pedestal 334 is attached to a portion of panel 349. Attaching the stabilizer feet to portions of bottom panel 349 enables tubular feet 338, 339, 340 to be raised or lowered with bottom panel 349 while at the same time permitting the bottom panel to remain in a loose or limp position until insert 365 is inserted on top of bottom panel 349 at which time panel 349 achieves a relatively taut position.

Figure 33:
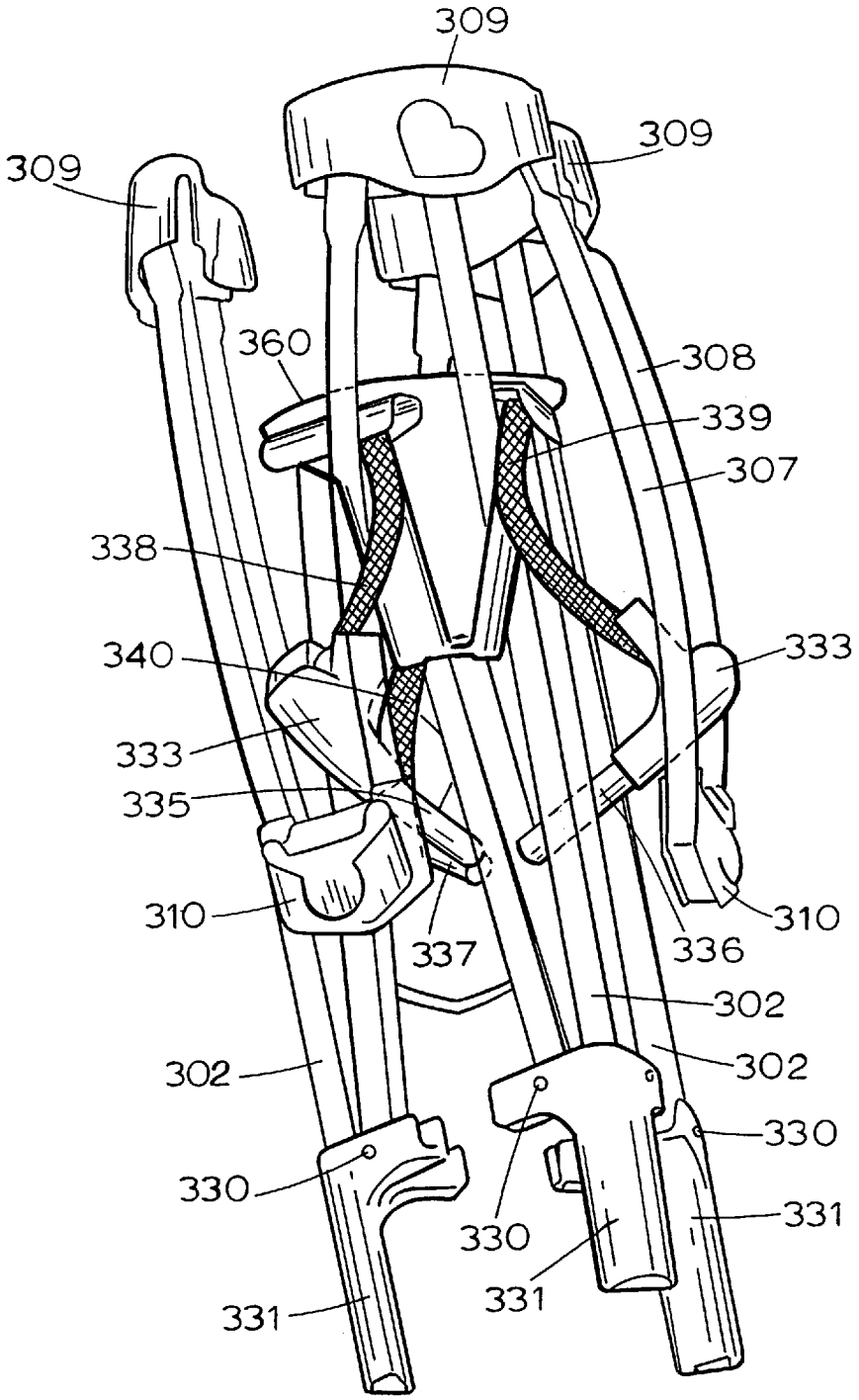
FIG. 33 shows a perspective view of the frame of the collapsed play yard embodiment of FIG. 24 with the stabilizer feet disposed in recesses of a pylon.

As seen in FIG. 28, the stabilizer feet 335, 336, and 337 are formed as 900 extensions of each tubular member 338, 339, and 340 and are adapted to pivot with respect to multiple pivot joint members 333 from the erected play yard position shown in solid lines in FIG. 27 to the collapsed play yard position illustrated in FIG. 28 and FIG. 33.

Referring to FIGS. 30 and 31, multiple pivot joint members 333 are formed to include integral right angled support pivot members 371, 372. Support pivot member 371 includes spaced support pivot member portions 373, 374 adapted to accommodate support pivot member 372 which is disposed 900 to portions 373, 374. Each support pivot member portion 373, 374 is pivotally connected to a respective leg portion of triangular-shaped bottom assembly 320. FIG. 30, for example, illustrates leg portion 325 pivotally connected by rivet 375 to support pivot member portion 373 and leg portion 328 pivotally connected by a rivet, not shown, to support pivot member portion 374. Support pivot member 372 of the multiple pivot joint member 333 is pivotally connected by rivet 341 to tubular member 339 of stabilizer foot 334. Accordingly, each multiple pivot joint member 333 provides for the pivotal movement of two leg portions as well as a stabilizer foot.

Figure 36:
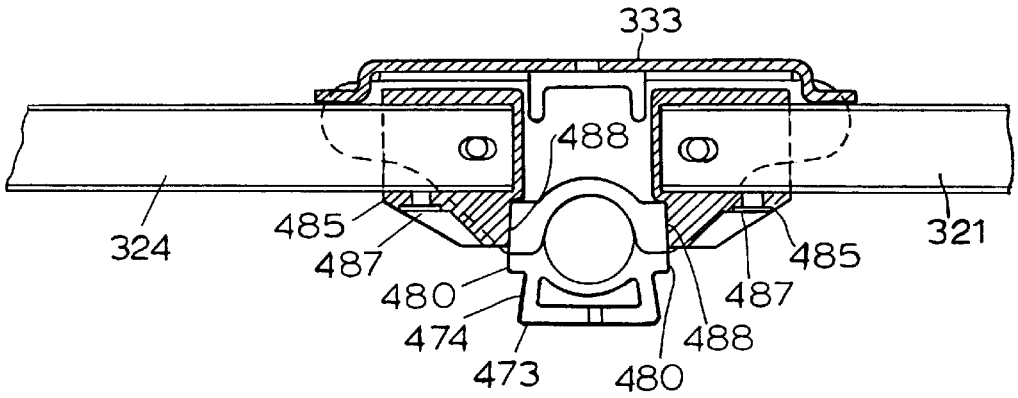
FIG. 36 shows a partial fragmentary front section view of the pivot joint member locked in position relative to the leg portions of a bottom leg assembly.
Figure 37:
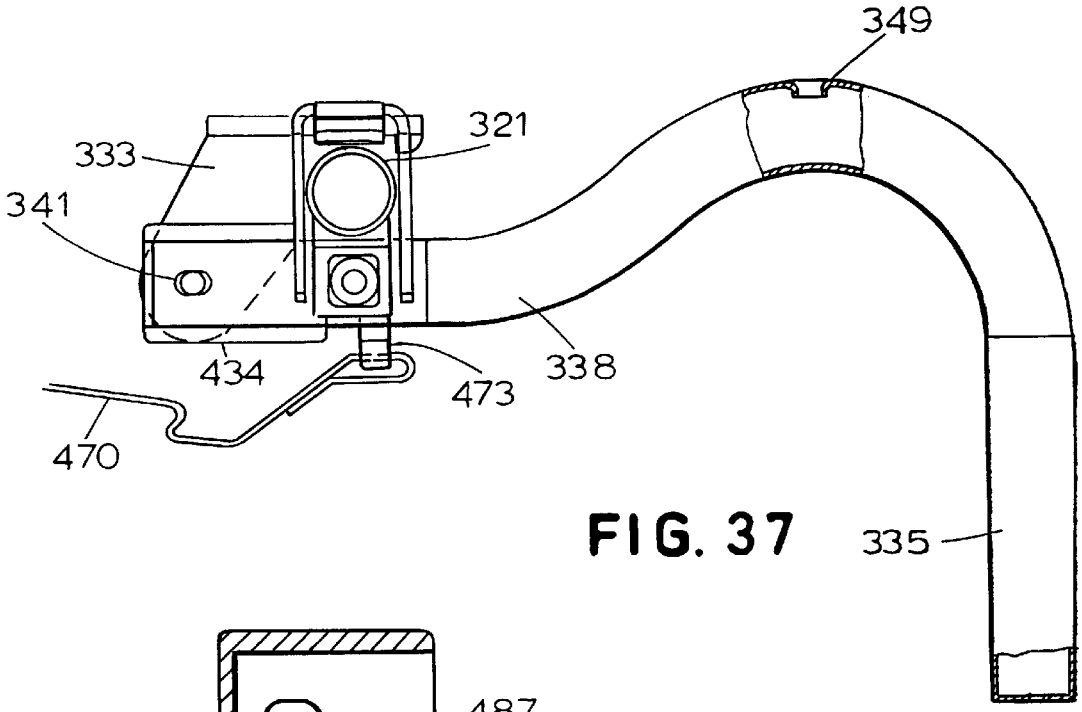
FIG. 37 shows a collar seated on each end of a pair of adjacent leg portions in FIG. 36.
Figure 39:
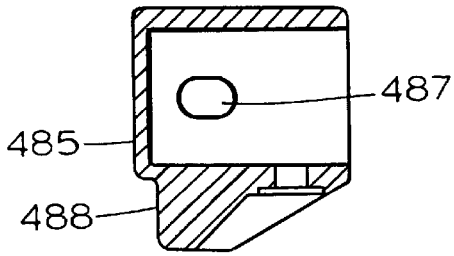
Figure 38A:
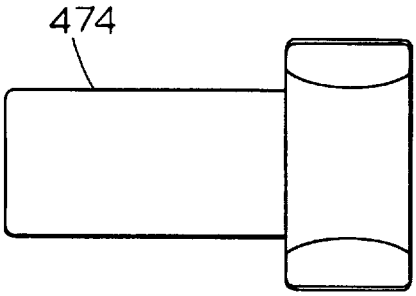
FIGS. 38*a–d* show the top, side, bottom, and front views of the collar seated on the stabilizer foot of FIG. 37, the collar being locked in position relative to the leg portion collars; and, FIG. 39 shows a collar adapted to seat on an end of each leg portion shown in FIG. 36.
Figure 38B:
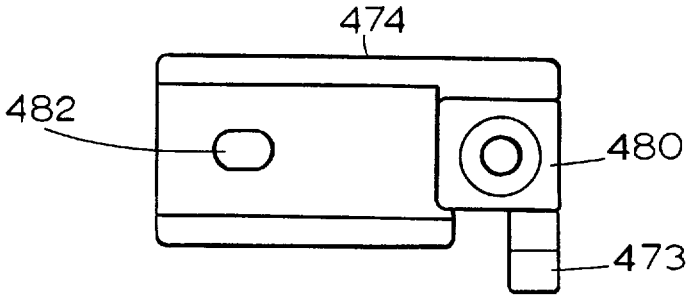
Figure 38C:
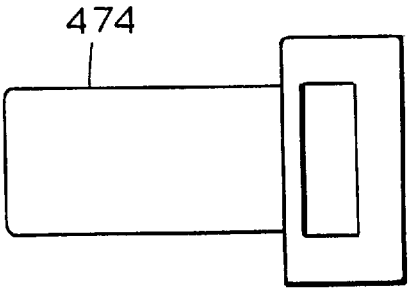
Figure 38D:
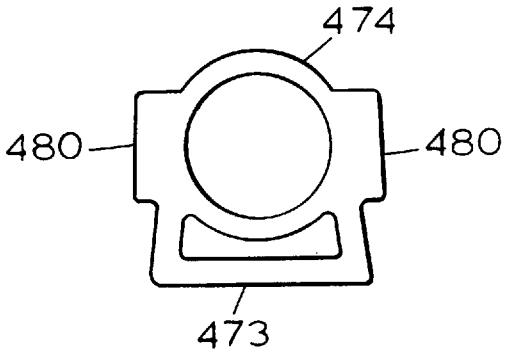

Turning to FIGS. 36–39, it is preferred to have a first collar 474 seated on the end of a stabilizer tubular member 338, 339 and 340. Collar 474 includes a pair of lugs 480. The collar has an opening 482 for receipt of a pivot connection 341. A second collar 485 is seated or capped on an end of each leg portion 321, 324. Collar 485 is fastened by a rivet or other suitable fastener 487 to a leg portion. Collar 485 also includes a recess 488 which is adapted to receive a lug 480. When a stabilizer foot 338, 339, 340 is in an erected position, such as illustrated in FIGS. 36, 37, the lugs are frictionally retained in recesses 488. The collars 474 and 485 preferably are molded members preferably made of polypropylene or other suitable polymeric material.

Figure 32:
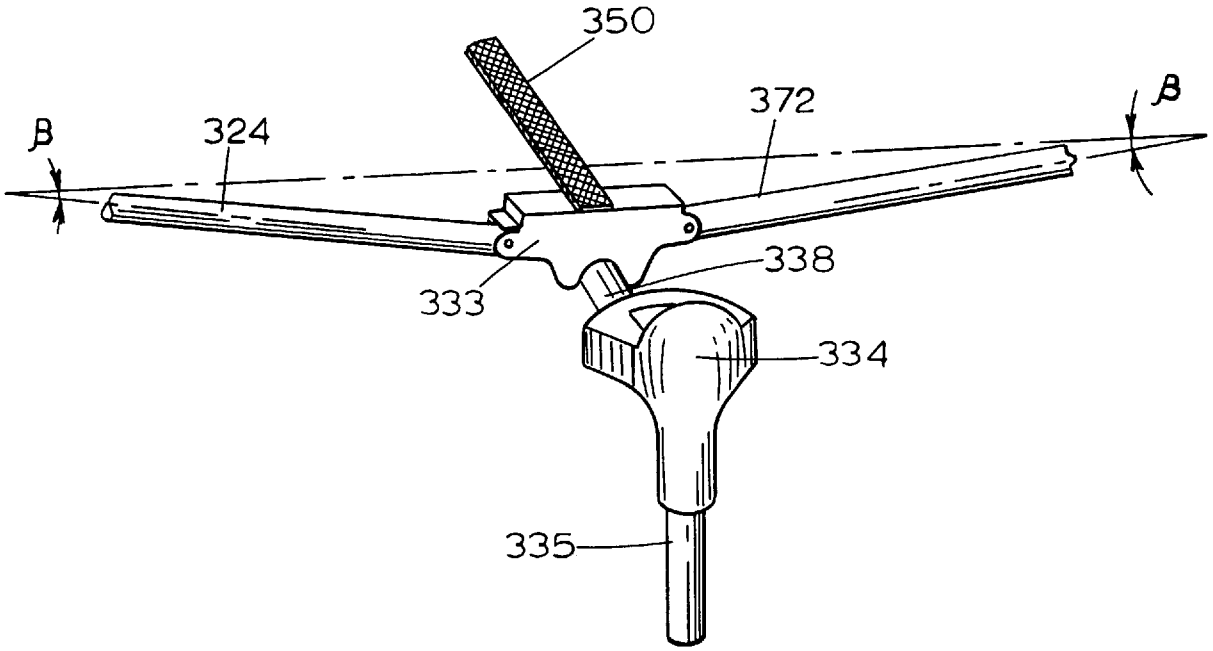
FIG. 32 shows a fragmentary, perspective view of the leg portions of one leg member when the play yard frame is in an open erected position.

Play yard 300 can be erected by allowing the top rail members to open to the position shown in FIG. 26. The leg portions of the lower support assembly 320 are pushed downward manually from the position shown in FIG. 26 to where the leg portions each extend downwardly past the center line to an angle in the range of about 2°–8° and preferably about 4°–6°. (See FIG. 32.) Placing the respective leg portions of each leg member in a downwardly extending position serves to assist placing tension on lower support assembly 320. Base insert 365 then is inserted on top of assembly 320, the outer edge of the base member contacting pedestals 334 and vertical posts 302 whereby the bottom panel 349 and play yard frame assembly are maintained in a taut, relatively stable position.

To collapse play yard 300 from the erected position shown in FIG. 24, base insert 365 is removed from the play yard. One then pulls upward in the direction of arrow "IT" in FIG. 27 on web strap loop 353, FIG. 25, whereupon the leg portions of assembly 320 pivot upwardly, FIG. 27, and stabilizer foot tubular members 338, 339, 340 pivot downwardly about their respective pivotal connections with the multiple pivot joint members 333. One then pulls up on rail joints 310, as previously described with respect to the play yard embodiments of FIGS. 1–23, whereupon the top rail assemblies 304, 305, 306 collapse as illustrated in FIG. 27.

Figure 34:
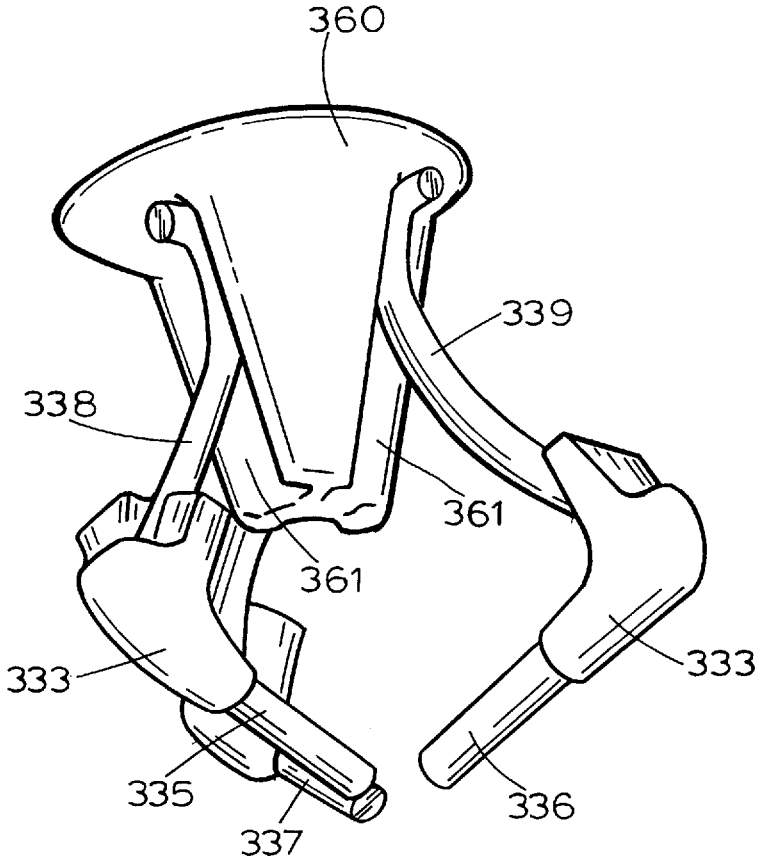
FIG. 34 shows a further perspective view of the stabilizer feet of FIG. 33 disposed in pylon recesses.

Vertical posts 302 move inwardly, whereupon play yard 300 assumes a folded, collapsed position and the stabilizer tubes 338, 339, 340 are disposed in recesses 361 located in pylon 360 to achieve a compact fold of the play yard (FIGS. 33 and 34). Subsequently, insert 365 is wrapped about folded play yard 300, whereupon the folded and wrapped unit can be inserted in a suitable bag-like carrying container.

In the alternative embodiment of FIG. 31, a web strap loop 400 may be attached by rivet 401 to each pivot joint member 333, thus replacing the need for web straps 350, 351, 352. Pulling upward on the three separate web strap loops 400, which are mounted to member 333 independent of the bottom fabric panel 349, assists in collapsing play yard 300 as previously described.

The frame of the play yard of the present invention can be made of any suitable metal, plastic or fiberglass material or mixtures thereof.

Moreover, while the play yard arrangement disclosed herein has been illustrated with a three-sided play yard, it is appreciated the play yard could be multi-sided. For example, a seven-sided play yard could be employed in which various stabilizer feet could be developed to carry various loads acting on the play yard. For example, a collapsible pentagonal assembly could be utilized in place of a triangular or three-sided assembly.

Similarly, while a triangular-shaped assembly has been shown with respect to play yard 300, it is appreciated that other three-sided shapes could be utilized without departing from the spirit of the invention. For example, it is expected that a collapsible round, concave or convex shaped segmented assembly could be utilized with the leg portions and rail members providing a desired shape.

Further, the top assembly has been illustrated with bowed members. It is appreciated that the rail members could be straight or otherwise shaped without departing from the spirit of the present invention.

While the present invention has been described in connection with illustrated embodiments, it will be understood to those skilled in the art that many changes and modifications may be made without departing from the true spirit and scope of the invention. It is therefore intended by the appended claims to cover all such changes and modifications which come within the true spirit and scope of the invention.

What is claimed is:

1. A three-sided play yard comprising:

three spaced vertical posts each having upper and lower ends;

a collapsible, three-sided top assembly connected to said vertical posts near the top ends of said posts;

a collapsible, three-sided bottom assembly including three collapsible legs, said three collapsible legs of said bottom assembly being connected to said vertical posts near the bottom ends of said posts, each of said collapsible legs including a first leg portion, a second leg portion, and a multiple pivot joint member pivotally connecting adjacent ends of said first and second leg portions;

three straps, each of the three straps being coupled to a respective one of said multiple pivot joint members;

whereby said top and bottom assemblies can be erected to an assembled position and collapsed to a disassembled position, said legs of said bottom assembly being collapsed by pulling on the straps.

2. A play yard in accordance with claim 1 wherein said three-sided bottom assembly includes stabilizer feet substantially equally spaced from adjacent vertical posts.

3. A play yard in accordance with claim 2 wherein each of said multiple pivot joint members also pivotally connects one of said stabilizer feet to a respective collapsible leg.

4. A play yard in accordance with claim 1 further comprising a pulling strap member interconnecting said straps.

5. A three-sided play yard comprising:

three spaced vertical posts each having upper and lower ends;

a collapsible, three-sided top assembly connected to said vertical posts near the top ends of said posts;

a collapsible, three-sided bottom assembly including three collapsible legs each having an associated collapsible stabilizer foot, said three collapsible legs of said bottom assembly being connected to said vertical posts near the bottom ends of said posts;

a pylon coupled to said bottom assembly, said pylon including a plurality of recesses, each of the recesses being sized to receive one of said stabilizer feet;

wherein said top and bottom assemblies can be erected to an assembled position and collapsed to a disassembled position.

6. A play yard in accordance with claim 5 wherein each of said collapsible legs of said three-sided bottom assembly includes a multiple pivot joint member, each said multiple pivot joint member being pivotally connected to one of said associated collapsible stabilizer foot.

7. A play yard in accordance with claim 6 including a panel assembly comprising three side panels, each side panel extending from said top assembly to said bottom assembly when said play yard is in an erected position; and, a bottom panel joined to said panels and adapted to seat on said bottom assembly.

8. A play yard in accordance with claim 7 and further including means for pulling on and collapsing said bottom assembly legs, said means being disposed on said play yard independent of said bottom panel.

9. A play yard comprising:

a plurality of spaced vertical posts each having upper and lower ends;

a collapsible top assembly connected to said vertical posts near the top ends of said posts; and, a collapsible bottom assembly including a plurality of collapsible legs, said collapsible legs of said bottom assembly being connected to said vertical posts near the bottom ends of said posts;

said bottom assembly including a plurality of straps, each of said straps being respectively coupled to a respective one of said collapsible legs for enabling collapsing of said bottom assembly;

wherein said top and bottom assemblies can be erected to an assembled position and collapsed to a disassembled position.

10. A play yard in accordance with claim 9 including a panel assembly comprising a plurality of side panels, each side panel extending from said top assembly to said bottom assembly when said play yard is in an erected position; and, a bottom panel joined to said panels and adapted to seat on said bottom assembly; and a removable base insert, said insert being disposed within said panel assembly adjacent said bottom panel.

11. A play yard in accordance with claim 10 including a pulling strap member interconnecting each of said straps, and said bottom panel having an aperture adapted to enable said pulling strap member to pass therethrough.

12. A play yard in accordance with claim 11 and further including a base insert disposed within said vertical panels and positioned adjacent said base panel to maintain said play yard bottom panel in a substantially taut position when said play yard is in an erect position.

13. A play yard in accordance with claim 10 wherein the removable base insert has a triangular shape and said play yard is three-sided.

14. A play yard comprising:

a plurality of spaced vertical posts each having upper and lower ends;

a collapsible top assembly connected to said vertical posts near the top ends of said posts;

a collapsible bottom assembly including collapsible legs, said collapsible legs of said bottom assembly being connected to said vertical posts near the bottom ends of said posts; each of said collapsible legs including a first leg portion, a second leg portion, and a multiple pivot joint member pivotally connecting adjacent ends of said first and second leg portions; and a plurality of stabilizer feet, each of said stabilizer feet being pivotably coupled to a respective one of the pivot joint members, each of said stabilizer feet being located between adjacent ones of the vertical posts and being spaced outwardly from a line connecting the adjacent vertical posts in a direction away from the center of the bottom assembly;

wherein said top and bottom assemblies can be erected to an assembled position and collapsed to a disassembled position.

15. A play yard in accordance with claim 14 further including vertical panel members connected to said top assembly and a bottom base panel connected to said vertical panel members, said base member being loosely disposed on top of said bottom assembly.

16. A play yard in accordance with claims 1 or 14 wherein said leg portions are positioned at an angle in the range of about 1°–8° when said play yard is formed erected free of a base insert.

17. A play yard in accordance with claims 1, 5, 9, or 14, in which said play yard is triangular-shaped.

18. A multi-sided play yard comprising:

a collapsible top assembly;

a collapsible bottom assembly;

a plurality of vertical posts each having two ends, a first end of each said post being connected to said top assembly and a second end of each said post being attached to said bottom assembly;

a plurality of multiple joint pivot members;

said bottom assembly comprising a plurality of legs, each leg comprising a pair of leg portions, each portion having two ends with one leg portion end being pivotally connected to said vertical post and the other leg portion end being pivotally connected to one of said multiple joint pivot members;

a plurality of stabilizer feet, each of said stabilizer feet being pivotally connected to a respective one of said joint pivot members a plurality of vertical panel members connected to and depending from said top assembly;

a bottom panel connected to said vertical panels and adapted to seat on said bottom assembly when said play yard is in an erected position;

a plurality of first flexible straps each of said first straps connecting a respective one of said stabilizer feet to said bottom panel to urge said one of said stabilizer feet in a first direction; and, a plurality of second straps, each of said second straps connecting a respective one of said stabilizer feet to said bottom panel to urge said stabilizer feet in a second direction.

19. A multi-sided play yard in accordance with claim 17 and further including flexible load support straps, each of said flexible load support straps being connected to a pair of adjacent legs.

20. A multi-sided play yard in accordance with claim 18 wherein each leg portion has a leg portion collar disposed on the end thereof contiguous to one of said joint members, said collar having a recess therein; and, said stabilizer feet each having a stabilizer foot collar seated thereon, said stabilizer foot collar having a pair of lugs therein, said lugs on said stabilizer foot collar being adapted to be received in recesses of said leg portion collars whereby each of said stabilizer feet is maintained in a locked position.

21. A multi-sided play yard in accordance with claim 18 and further including a pylon depending from the bottom panel.

22. A multi-sided play yard in accordance with claim 21 in which said pylon includes a plurality of recesses.

23. A multi-sided play yard in accordance with claim 18 wherein said play yard comprises three sides.

24. A multi-sided play yard comprising:

a collapsible top assembly;

a collapsible bottom assembly;

a plurality of vertical posts each having two ends, a first end of each said post being connected to said top assembly and a second end of each said post being attached to said bottom assembly;

a plurality of multiple joint pivot members;

said bottom assembly comprising a plurality of legs, each leg comprising two leg portions, each leg portion having two ends with one leg portion end being pivotally connected to said vertical post and the other leg portion end being pivotally connected to one of said multiple joint pivot members, the leg portions being arranged in pairs wherein each pair is coupled to a respective one of said vertical posts;

a plurality of stabilizer feet, each of said stabilizer feet being pivotally connected to a respective one of said joint pivot members; and a plurality of flexible load support straps, each said flexible load support straps being connected to a respective one of said pairs of adjacent legs.

25. A multi-sided play yard comprising:

a collapsible top assembly;

a collapsible bottom assembly;

a plurality of vertical posts each having two ends, a first end of each said post being connected to said top assembly and a second end of each said post being attached to said bottom assembly;

a plurality of multiple joint pivot members;

said bottom assembly comprising a plurality of legs, each leg comprising two leg portions, each leg portion having two ends with a first leg portion end being pivotally connected to said vertical post and a second leg portion end being pivotally connected to one of said multiple joint pivot members, each of said leg portions having a leg portion collar disposed on its said second leg portion end, each of said leg portion collars having a recess therein;

a plurality of stabilizer feet, each of said stabilizer feet being pivotally connected to a respective one of said joint pivot members and including a stabilizer foot collar having a pair of lugs, each of said lugs being sized for receipt in a respective one of said recesses in said leg portion collars for maintaining an associated stabilizer foot in a locked position.

* * * * *